US006123329A

United States Patent [19]

Sato et al.

[11] Patent Number: 6,123,329

[45] Date of Patent: Sep. 26, 2000

[54] PAPER FEEDER AND PAPER TRAY ELEVATION DEVICE THEREFOR

[75] Inventors: Mitsuo Sato, Shibata-machi; Hidetoshi Aizawa, Ōkawara-machi; Kenji Endo, Fukushima; Naoki Ashikaya, Iwanuma; Kiyohiko Yakuwa; Masayuki Shima, both of Sendai, all of Japan

[73] Assignee: Tohoku Ricoh Co., Ltd., Shibata-gun, Japan

[21] Appl. No.: 09/151,351

[22] Filed: Sep. 10, 1998

[30] Foreign Application Priority Data

Dec. 26, 1997 [JP] Japan ..... 9-360683
Jul. 14, 1998 [JP] Japan ..... 10-199188

[51] Int. Cl.[7] ..... B65H 3/44

[52] U.S. Cl. ..... 271/9.01; 271/145; 271/162; 271/158; 271/9.06; 271/9.08; 271/9.12; 414/789.9; 414/796.8

[58] Field of Search ..... 271/9.01, 145, 271/171, 9.12, 162, 164, 158, 159, 9.02, 9.06, 9.08; 414/789.9, 790.1, 796.7, 796.8, 790.4, 788.1, 789.8, 790.9, 791, 791.2, 924, 926

[56] References Cited

U.S. PATENT DOCUMENTS

| | | | |
|---|---|---|---|
| 3,067,885 | 12/1962 | Kohler | 414/796.7 |
| 3,233,891 | 2/1966 | Denton et al. | 414/926 X |
| 3,761,080 | 9/1973 | Larson | 271/89 X |
| 3,780,884 | 12/1973 | Jones | 414/796.7 X |
| 3,820,777 | 6/1974 | Reehil | 271/61 |
| 3,890,185 | 6/1975 | Umazume | 414/796.7 X |
| 4,211,398 | 7/1980 | Bishop | 271/9 |
| 4,253,759 | 3/1981 | Rattin | 271/95 X |
| 4,273,490 | 6/1981 | James | 414/95 |
| 4,423,995 | 1/1984 | Karis | 414/98 X |
| 4,765,790 | 8/1988 | Besemann | 414/790.4 |
| 4,867,277 | 9/1989 | Sloan | 187/9 |
| 5,102,112 | 4/1992 | Takahashi | 271/154 X |
| 5,150,893 | 9/1992 | Uno et al. | 271/157 |
| 5,195,734 | 3/1993 | Tanabe | 271/9 |
| 5,335,903 | 8/1994 | Martin et al. | 271/57 |
| 5,400,720 | 3/1995 | Stevens | 108/147 |
| 5,829,948 | 11/1998 | Becklund | 414/785 X |
| 5,971,387 | 10/1999 | Kita | 414/795.8 |

FOREIGN PATENT DOCUMENTS

| | | |
|---|---|---|
| 59-211061 | 11/1984 | Japan . |
| 5-124737 | 5/1993 | Japan . |
| 5-221536 | 8/1993 | Japan . |
| 5-229243 | 9/1993 | Japan . |
| 5-306025 | 11/1993 | Japan . |
| 6-40137 | 2/1994 | Japan . |
| 6-72566 | 3/1994 | Japan . |
| 6-144600 | 5/1994 | Japan . |
| 7-137851 | 5/1995 | Japan . |

*Primary Examiner*—Christopher P. Ellis
*Assistant Examiner*—Richard Ridley
*Attorney, Agent, or Firm*—Oblon, Spivak, McClelland, Maier & Neustadt, P.C.

[57] ABSTRACT

A paper feeder for feeding papers to an image forming apparatus and a paper tray elevation device therefore are disclosed. A first tray is movable up and down with a plurality of papers stacked thereon. A paper feed member feeds the papers from the first tray in a preselected direction of paper feed. A second tray is positioned beside the first tray in substantially the horizontal direction and movable up and down with a plurality of papers stacked thereon. A shifting device shifts the entire paper stack from the second tray to the first tray. A horizontal elevating mechanism elevates the first tray while maintaining it in substantially the horizontal position. An interlocking mechanism at least elevates, when papers of greater in size than the papers to be stacked on the first or second tray are stacked over the first and second trays in a single stack, the second tray in interlocked relation to the elevation of the first tray while maintaining the second tray in substantially the horizontal position. The papers of greater size are capable of being stacked over the first and second trays and fed by the paper feed member.

20 Claims, 21 Drawing Sheets

PAPER FEEDER AND PAPER TRAY ELEVATION DEVICE THEREFOR

BACKGROUND OF THE INVENTION

The present invention relates to an image forming apparatus and, more particularly, to a paper feeder to feeding papers to an image forming apparatus and a paper tray elevation device therefore.

Generally, a copier, printer, facsimile apparatus or similar image forming apparatus extensively used today has a paper feeder therein for feeding papers to be recorded with images. Particularly, an electrophotographic copier expected to deal with a relatively small number of papers at a time usually has a paper feeder facilitating the replenishment of papers, easy to operate, and capable of feeding even a great number of papers, as needed. For example, Japanese Patent Laid-Open Publication Nos. 5-124737, 5-221536, 6-144600 and 7-137851 each discloses a so-called front loading paper feeder allowing the operator to replenish papers at the front of an apparatus on which the paper feeder is mounted, and capable of automatically replenishing papers without interrupting paper feed under way.

The paper feeder includes a paper tray elevation device for causing a paper tray loaded with a stack of papers to move up and down. For the elevation device to move the paper tray up and down, use has customarily been made of either one of a cantilever system and a horizontal elevation system or wire system. However, the problem with the conventional elevation device, whether it be of the cantilever system or the horizontal elevation system, is that when papers of relatively great size or a great number of papers are stacked on the tray, the papers cannot be held in an adequate or stable position on the tray. Specifically, such papers are irregularly positioned, deformed or fed in an unstable condition.

Technologies relating to the present invention are also disclosed in, e.g., Japanese Patent Laid-Open Publication Nos. 59-211061, 5-229243, 5-306025, 6-40137, and 6-72566.

SUMMARY OF THE INVENTION

It is therefore an object of the present invention to provide a paper feeder capable of preventing, when papers of relatively great size or a great number of papers are stacked on a paper tray, the papers from being irregularly positioned, deforming or being fed in an unstable condition, and a paper tray elevation device therefor.

In accordance with the present invention, a paper feeder includes a first tray movable up and down with a plurality of papers stacked thereon. A paper feed member feeds the papers from the first tray in a preselected direction of paper feed. A second tray is positioned beside the first tray in substantially the horizontal direction and movable up and down with a plurality of papers stacked thereon. A shifting devices shifts the entire paper stack from the second tray to the first tray. A horizontal elevating device elevates the first tray while maintaining it in substantially the horizontal position. An interlocking mechanism at least elevates, when papers or relatively great size greater than the size of the papers to be stacked on the first or second tray are stacked over the first tray and second trays in a single stack, the second tray in interlocked relation to the elevation of the first tray while maintaining the second tray in substantially the horizontal position. In this configuration, the papers of relatively great size are capable of being stacked over the first and second trays and fed by said paper feed member.

Also, in accordance with the present invention, a device for moving a tray in the up-and-down direction includes a tray elevatable with a plurality of papers tacked thereon, an X-shaped parallel link mechanism for elevating the tray while maintaining it in substantially the horizontal position, and a drive source engaged with a shaft connecting the parallel link for moving the tray up and down.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1A:
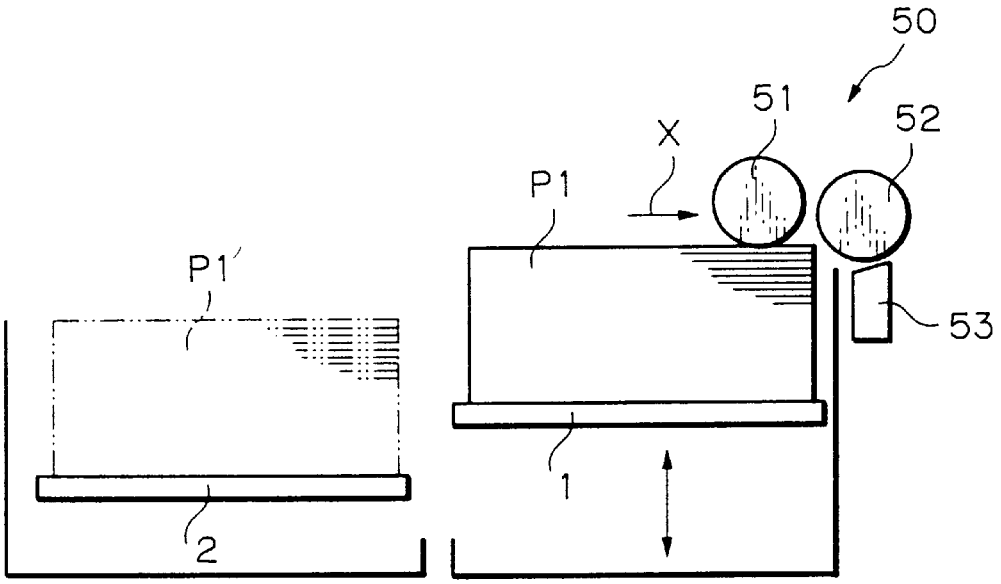
Fig. 1A PRIOR ART
FIGS. 1A and 1B are front views showing a conventional paper feeder using the horizontal elevation system or wire system and operating in a non-tandem paper feed mode.
Figure 1B:
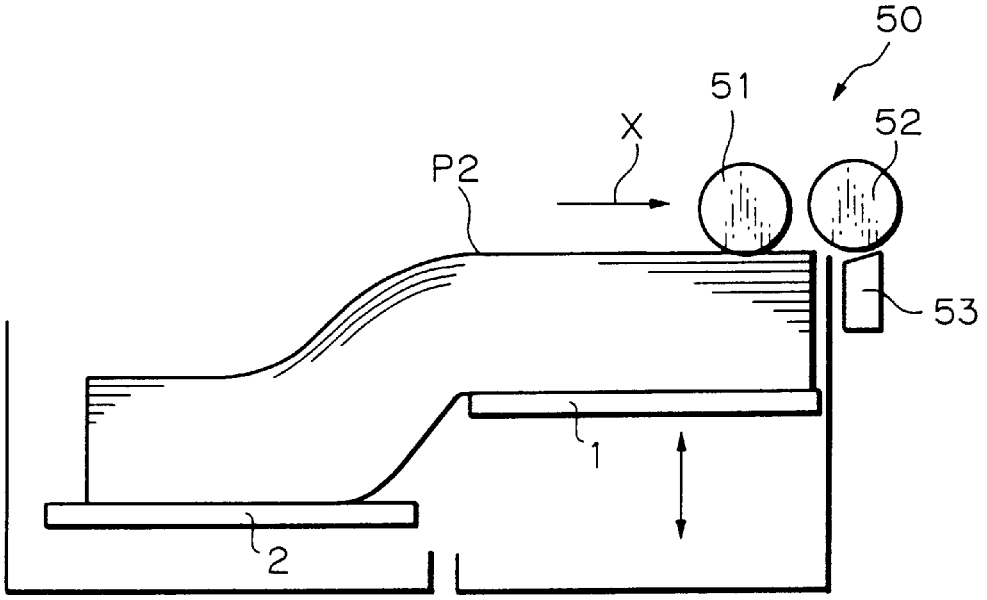
Fig. 1B PRIOR ART

To better understand the present invention, brief reference will be made to a conventional paper feeder using the horizontal elevation system or wire system, shown in FIGS. 1A and 1B. As shown, the paper feeder, generally 50, includes an elevatable right tray 1 loaded with a stack of papers P1. A pick-up roller 51 is pressed against the top paper P1 of the right tray 1 in order to feed it in a preselected paper feed direction X. A separator roller 52 and a separator pad 53 cooperate to separate the top paper P1 paid out by the pick-up roller 51 from the underlying papers P1. A left tray 2 is positioned beside the right tray 1 in substantially the horizontal direction. The left tray 2 is movable into and out of an apparatus body in the direction substantially perpendicular to the paper feed direction X, i.e., in the front-and-rear direction as seen in FIGS. 1A and 1B. Shifting means, not shown, is capable of shifting the entire stack of papers P1' loaded on the left tray 2 to the right tray 1. The paper feeder 50 allows a single stack of papers P2, FIG. 1B, greater in size than at least the papers P1 or P1' to be stacked over both of the right tray 1 and left tray 2 and causes the pick-up roller 51 to feed such papers P2 also.

The right tray 1 and left tray 2 respectively allow the papers P1 and P1' of the same relatively small size (although distinguished by apostrophe) to be stacked thereon. For example, both the papers P1 and P1' stacked on the trays 1 and 2, respectively, are of size A4 (long-edge feed position); about 500 papers P1 and about 500 papers P1', i.e., about 1,000 papers can be stacked on the trays 1 and 2. When the tray 1 runs out of the papers P1, an end fence constituting the shifting means is moved from the left to the right so as to shift the entire stack P1' from the tray 2 to the tray 1. Then, an elevating device, not shown, associated with the tray 1 presses the top of the stack P1' against the pick-up roller 51. This kind of paper feed is generally referred to as tandem paper feed.

The paper feeder 50 further includes a side fence assembly fastened to the right tray 1 by screws or similar fastening means, although not shown specifically. Briefly, the side fence assembly includes a pair of side fences for positioning the stack P1 or P1' on the tray 1 in the widthwise direction, a pair of back fences automatically movable to stop the rear edge of the stack P1 or P1' positioned by the side fences, and a rotary solenoid or similar drive source for moving the back fences. The side fence assembly can be shifted either manually or automatically in matching relation to a desired paper size. For example, a single stack of papers of size A3 (short-edge feed position) greater than the papers of size A4 (long-edge feed position) to be stacked on the tray 1 or 2 can be stacked on both of the trays 1 and 2 and fed by the pick-up roller 51. This kind of paper feed is generally referred to as non-tandem paper feed.

The elevation system for the right tray 1, whether the paper feed be tandem or non-tandem, is either the cantilever system or the horizontal elevation system or wire system, as stated earlier. In the cantilever system, a presser plate is rotatable and elevatable to lift the front edge portion of the stack P1 or P1', as viewed in the paper feed direction X, until it abuts against the pick-up roller. In the horizontal elevation system, wires, not shown, raise the tray 1 until it abuts against the pick-up roller 51, while maintaining it in a horizontal position, as shown in FIGS. 1A and 1B.

The above conventional paper tray elevation systems bring about the following problems particularly when dealing with a great number of papers.

As for the cantilever system, the stack P1, P1' or P2 is inclined (more than the position shown in FIG. 1B) in both of the tandem paper feed and non-tandem paper feed. In this condition, the separating ability available with the separator roller 52 and separator pad 53 is deteriorated, obstructing paper feed or causing a jam to occur. Further, in both the tandem paper feed and non-tandem paper feed, the number of papers P1, P1' or P2 that can be stacked on the tray 1 or over the two trays 1 and 2 is limited. For example, when more than 500 PPC (Plain Paper Copier) papers are stacked, the resulting load exceeds a practical range designed for the cantilever system.

As for the horizontal elevation or wire system, assume that papers of A3 or similar size greater than papers of size A4 are stacked in the non-tandem paper feed shown in FIG. 1B. Then, the papers P2 cannot be regularly positioned. Another problem is that the papers P2 deform between the two trays 1 and 2; the deformation is aggravated when the number of papers P2 increases. Moreover, the papers P2 cannot be stably fed. Specifically, in a stencil printer or similar printer, when the printing speed is increased, the path along which the papers P2 are fed in the direction X differs from the time when the number of papers P2 on the tray 1 is maximum to the time when it is small. This has adverse influence on stable paper feed and is apt to cause a jam or similar trouble to occur.

The problems discussed above are particularly serious with a stencil printer or similar image forming apparatus expected to produce a great number of printings at a time. There is an increasing demand for a stencil printer having a great printing capacity, i.e., capable of being constantly loaded with at least about 1,000 papers and operable at a high speed. By contrast, an electrophotographic copier or similar image forming apparatus produces a relatively small number of copies at a time (continuous feed of 1,000 papers suffices even in the tandem paper feed) and operates at a lower speed than the stencil printer. Therefore, it is not necessary to stack a great amount of papers in the copier. However, the above problems will also occur with the copier in the future due to the increasing copying speed.

Preferred embodiments of the present invention free from the above problems will be described hereinafter. In the embodiments to be described, structural elements identical in function and configuration are designated by identical reference numerals and will not be repeatedly described. As for structural elements provided in pairs, only one of them will be described except when distinction is required.

1st Embodiment

Figure 2:
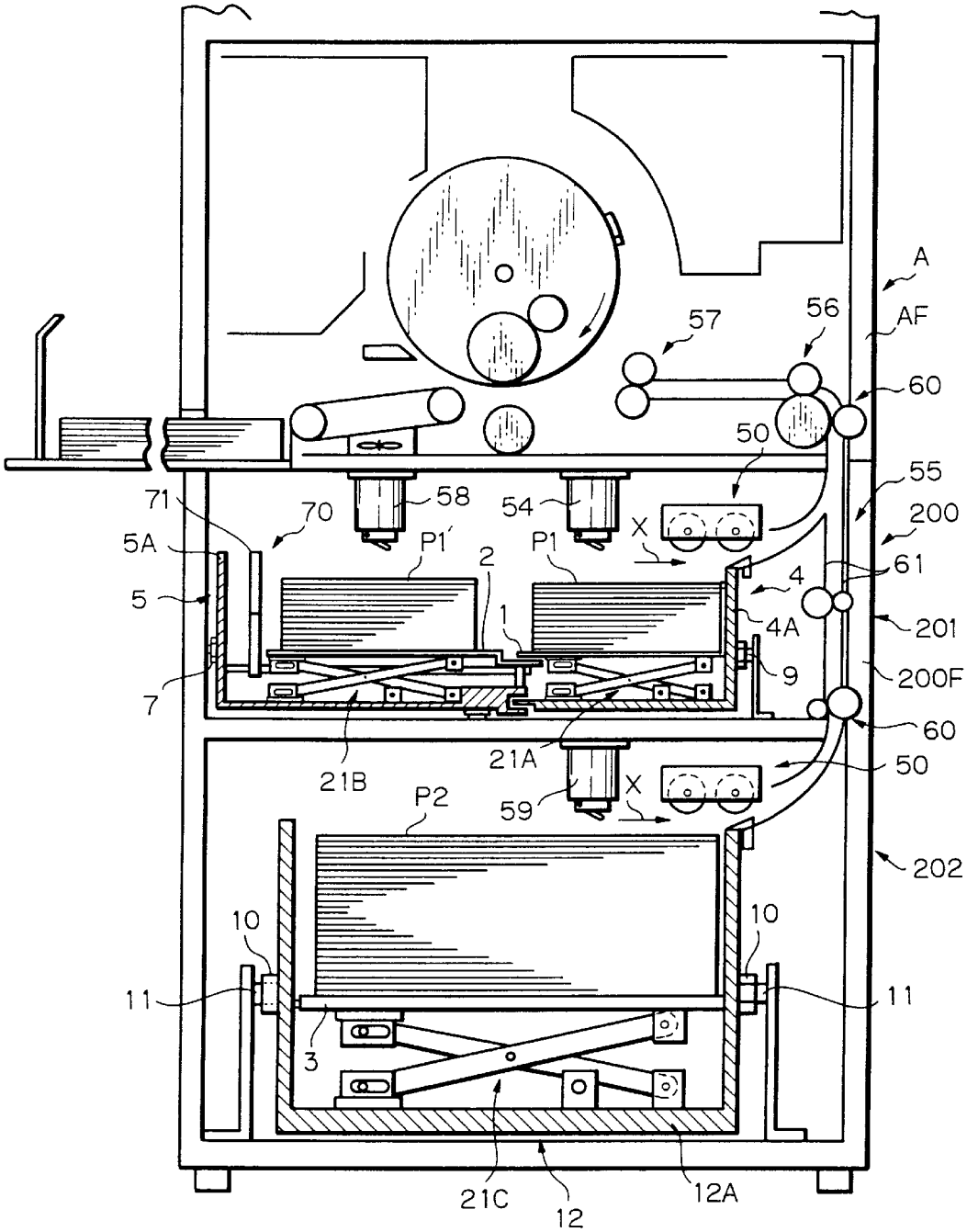
FIG. 2 is a sectional front view showing a first embodiment of the paper feeder in accordance with the present invention and applied to a stencil printer by way of example.
Figure 3:
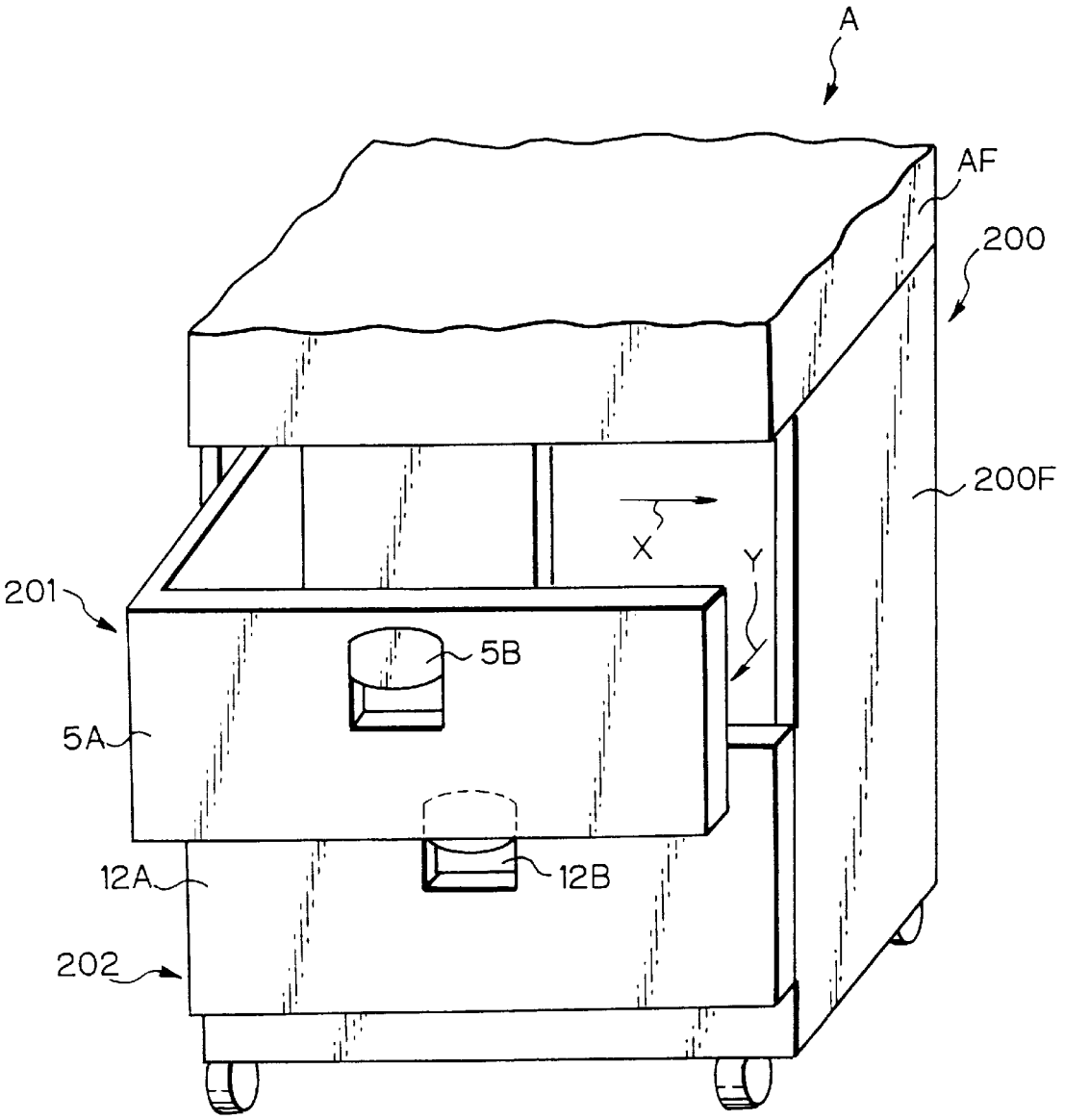
FIG. 3 is a fragmentary perspective view of the first embodiment.

Referring to FIGS. 2 and 3, an image forming apparatus including a paper feeder embodying the present invention is shown and implemented as a stencil printer by way of example. As shown, the stencil printer, generally A, includes a body or frame AF. A paper feeder 200 is arranged in the lower portion of the stencil printer A and includes a plurality of paper feed stages. The paper feeder 200 includes a paper feeder frame 200F removably inserted in the lower portion of the printer body AF. The stencil printer A has a conventional construction, e.g., one taught in Japanese Patent Laid-Open Publication No. 5-229243 mentioned earlier. The paper feeder 200 is generally made up of an upper paper feed section 201 and a lower paper feed section 202 arranged in the paper feeder fame 200F.

Figure 4:
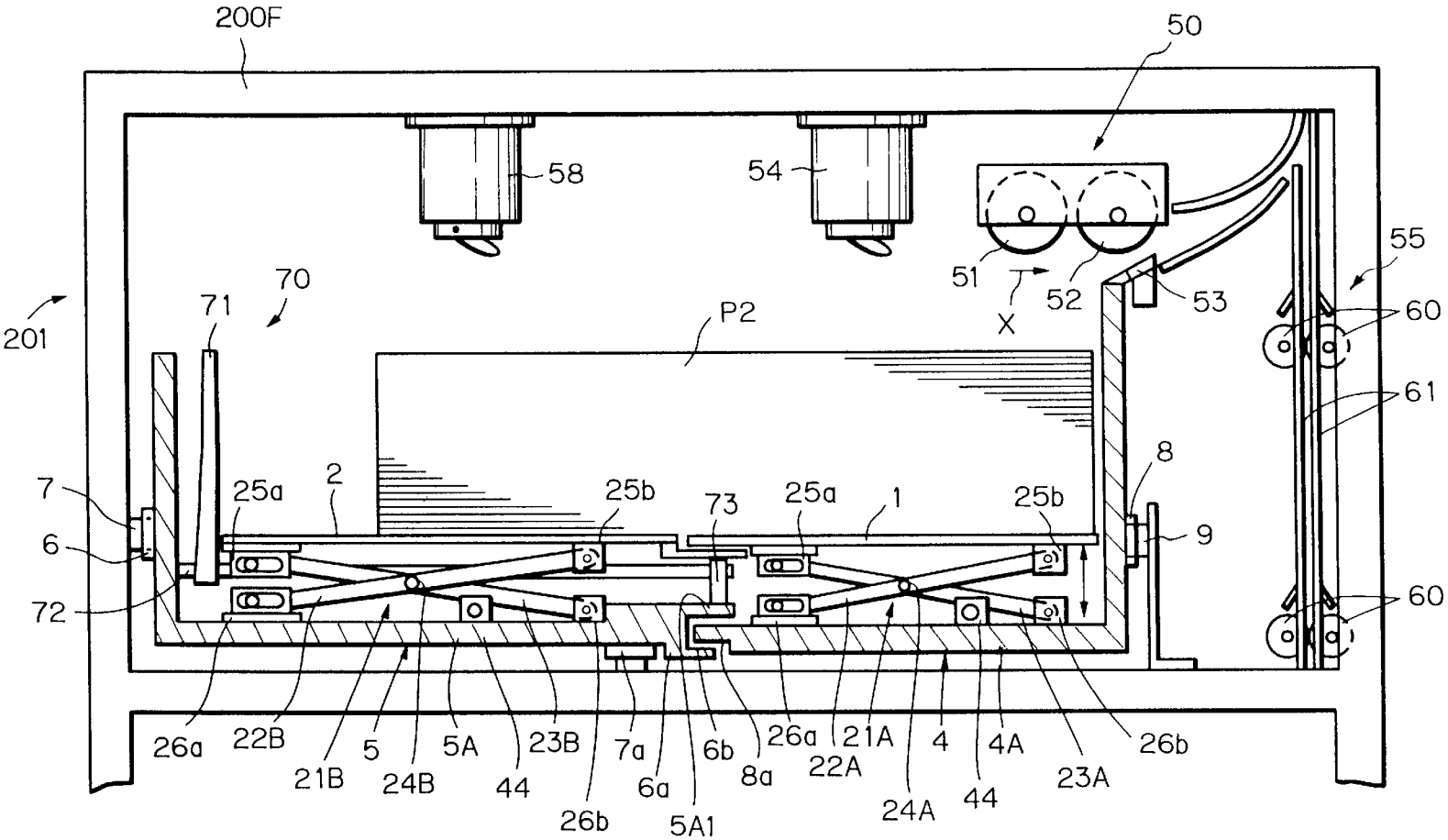
FIG. 4 is a section showing an upper paper feed section included in the first embodiment.

The upper paper feed section 201 includes a right tray unit 4 including a right tray or first tray 1 elevatable with papers P1 stacked thereon and horizontal elevating means, which will be described, for elevating the tray 1 while maintaining it in a horizontal position. Paper feeding means 50 feeds the papers P1 from the right tray 1 one by one in a paper feed direction X. A left tray unit 5 includes a left tray or second tray 2, shifting means 70, and interlocking means which will be described. The left tray 2 is positioned beside the right tray 1 in substantially the horizontal direction and loaded with a stack of papers P1'. The shifting means 70 is used to shift the entire stack P1' from the left tray 2 to the right tray 1. As shown in FIG. 4, when papers P2 of relatively great size are stacked single stack over the two trays 1 and 2, the interlocking means mentioned above raises the tray 2 in interlocked relation to the elevation of the tray 1. First tray supporting means, which will be described later, removably supports the right tray 1 on the paper feeder frame 200F via the right tray unit 4. Second tray supporting means, which will also be described later, removably supports the left tray 2 on the paper feeder frame 200F via the left tray unit 5. The papers P2 greater in size than the papers to be stacked on the right tray 1 or the left tray 2 can be stacked over the two trays 1 and 2 and fed by the paper feeding means 50.

With the above configuration, the upper paper feed section 201 is capable of selectively operable in a tandem paper feed mode or in a non-tandem paper feed mode. The right tray unit 4 and left tray unit 5 including the right tray 1 and left tray 2, respectively, are independent of each other and movable into and out of the paper feeder frame 200F in the direction perpendicular to the sheet surface of FIG. 2, i.e., in a forward direction Y shown in FIG. 3 and a rearward direction opposite thereto.

As shown in FIGS. 2 through 4, the right tray unit 4 includes a box-like case 4A to which the right tray 1, horizontal elevating means and other constituents are mounted. Likewise, the left tray unit 5 includes a box-like case 5A to which the left tray 2, interlocking means and other constituents are mounted. The sides of the cases 4A and 5A facing each other are open to form a paper shift path, so that the papers P1' can be bodily shifted from the left tray 2 to the right tray 1. As shown in FIG. 3, a knob 5B is affixed to the front end of the case 5A and is used to pull out the left tray unit 5.

In the illustrative embodiment, the right tray 1 and left tray 2 each allows at least 750 plain papers of any one of sizes A4, LT and B5 to be stacked thereon, so that 1,500 papers in total can be stacked on the trays 1 and 2. Of course, papers of any other size can be stacked on the trays 1 and 2, as needed.

As shown in FIGS. 2 and 3, the lower paper feed section 202 includes a bottom tray unit 12 including a bottom tray 3 elevatable with papers P2 stacked thereon and horizontal elevating means, which will be described later, for elevating the bottom tray 3 while maintaining it a horizontal position. Paper feeding means 50 feeds the papers P2 from the bottom tray 3 one by one in the paper feed direction X. Tray supporting means, which will be described later, removably supports the bottom tray 3 on the paper feeder frame 200F.

The bottom tray unit 12 including the bottom tray 3 is movable into and out of the paper feeder frame 200F in the direction perpendicular to the sheet surface of FIG. 2, i.e., in the direction Y and the opposite direction. In the illustrative embodiment, the bottom tray 3 allows even the papers P2 of relatively large size, e.g., size A3 to be stacked thereon. At least 1,000 papers in the form of plain papers can be stacked on the bottom tray 3. As shown in FIG. 2, the bottom tray unit 12 includes a box-like case 12A to which the bottom tray 3, horizontal elevating means and other constituents are mounted. As shown in FIG. 3, a knob 12B is affixed to the front end of the case 12A and used to pull out the bottom tray unit 12.

The right tray 1, left tray 2 and bottom tray 3 each is implemented by sheet steel and provided with strength matching with the size and number of papers to be loaded. The cases 4A, 5A and 12A each is implemented by a molding of synthetic resin using an insert of, e.g., sheet metal.

Figure 6:
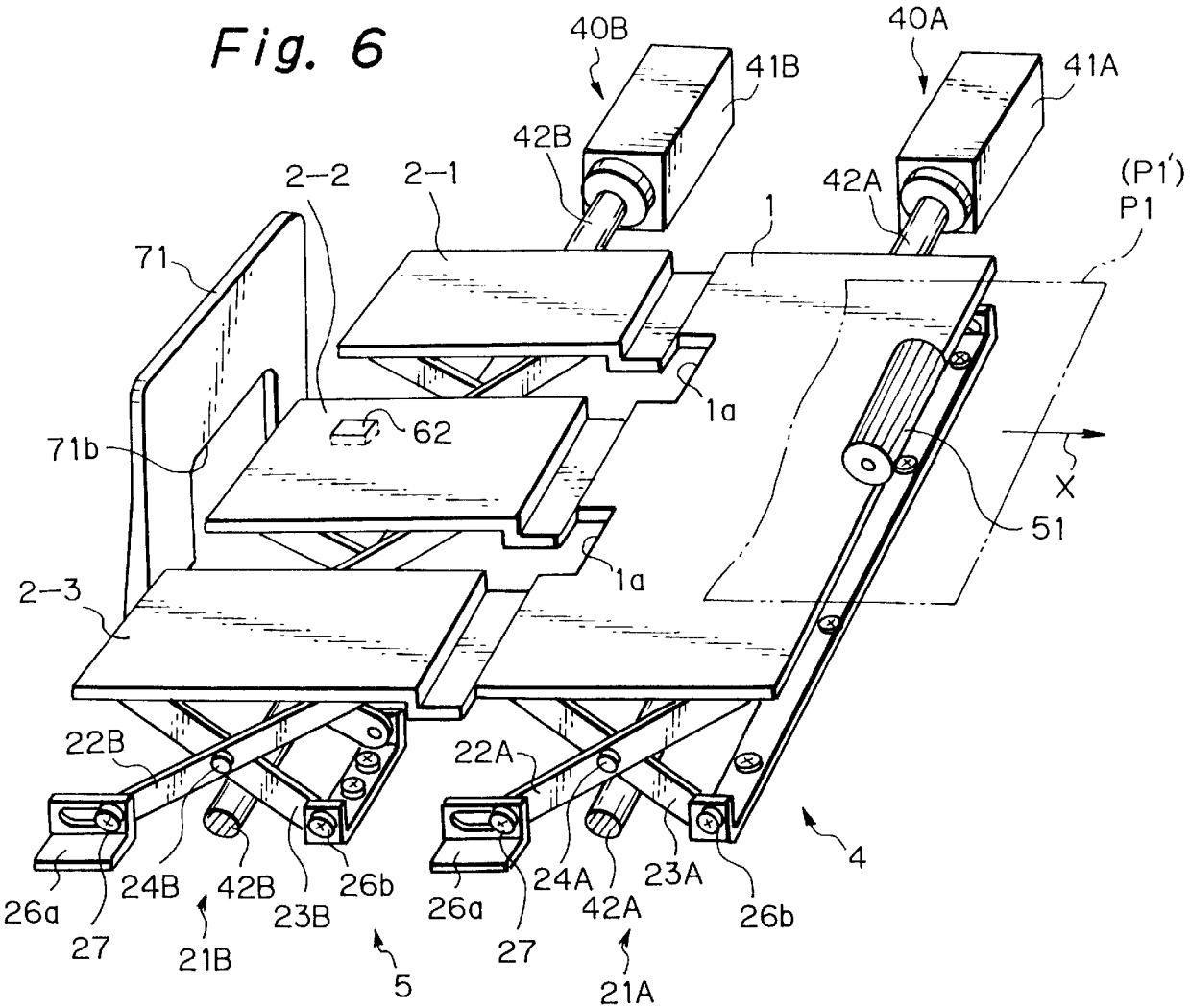
FIG. 6 is a fragmentary perspective view of the upper paper feed section.

The rear end of the right tray 1 is so removed as to receive a movable end fence 71 constituting the shifting means 70. As shown in FIG. 6, the left tray 2 is divided into three parts 2-1, 2-2 and 2-3. It is to be noted that the three parts are designated by 2-1, 2-2 and 2-3 only in a plan view and a perspective view. In FIG. 6, the dimensional relation between the left end of the right tray 1 and the right end of the left tray 2 is exaggerated for easy understanding; the accurate dimensional relation is shown in FIG. 4.

A paper sensor 62 is located at a preselected position on the center tray part 2-2 and implemented by a reflection type photosensor. The paper sensor 62 is responsive to the papers P1' stacked on the left tray 2.

Referring again to FIG. 2, the paper P1, P1' or 2 fed by the paper feeding means 50 of either one of the upper paper feed section 201 and lower paper feed section 202 is routed through a common vertical transport path 55 to a turning section 56 positioned in the lower portion of the printer body AF. The turning section 56 steers the paper P1, P1' or P2 toward a registration roller pair 57 adjoining a printing section. The registration roller pair 57 drives the paper P1, P1' or P2 toward the printing section at a preselected timing. The vertical transport path 55 and turning section 56 are provided with a suitably driven conveyor roller 60 and a guide 61 for guiding the paper P1, P1' or P2.

The upper paper feed section 201 and lower paper feed section 202 will be described in detail hereinafter.

As shown in FIG. 4, the first tray supporting means consists of a member 9 protruding from a bracket mounted on the bottom of the printer body 200, and a stepped support portion 6*b* included in the case 5A of the left tray 2. A slide rail 8 having a generally U-shaped section is formed on the outer surface of the right wall of the case 4A of the right tray unit 4. The member 9 is loosely received in the slide rail 8. A stepped slide portion 8*a* is formed at the left end of the case 4A and supported by the support portion 6*b* of the case 5A.

As also shown in FIG. 4, the second tray supporting means consists of members 7 and 7*a* protruding from the inner periphery of the paper feeder frame 200F. A slide rail 6 having a generally U-shaped section is formed on the outer surface of the left wall of the case 5A. The member 7 is loosely received in the slide rail 6. A stepped rail portion 6*a* is formed on the right portion of the bottom of the case 5A and slidingly engaged with the member 7*a*.

The left tray unit 5 supported by the members 7 and 7*a* can be pulled out of the paper feeder frame 200F in the direction Y perpendicular to the sheet surfaces of FIGS. 2 and 3. Likewise, the right tray unit 4 supported by the member 9 and the stepped portion 6*b* of the left tray 5 can be pulled out of the paper feeder frame 200F in the direction Y.

Each paper feeding means 50 has a pick-up roller 51, a separator roller 52, and a separator pad 53. The pick-up roller 51 is pressed against the top paper P1, P1' or P2 of the right tray 1 or the bottom tray 3 for feeding the paper in the paper feed direction X. The separator roller 52 and separator pad 53 cooperate to separate the top paper from the underlying papers.

Paper sensors 54 and 58 are respectively mounted on the paper feeder frame 200F above the right tray 1 and left tray 2 of the upper paper feed section 201. The paper sensors 54 and 58 respectively sense the top papers P1 and P1' of the trays 1 and 2 located at their substantially upper limit positions adjoining a preselected paper feed position.

The left tray unit 5 will be described more specifically for the illustration reason. The interlocking means mainly consists of three parallel link mechanisms 21B and drive means 40B. The parallel link mechanisms 21B respectively support the three parts 2-1, 2-2 and 2-3 of the left tray 2 such that each of them is movable up and down in a horizontal position. The drive means 40B causes the parallel link mechanisms 21B to move up and down. Each parallel link mechanism 21B has link plates 22B and link arms 23B each being rotatably connected with one of the link plates 22B by a shaft 24B at its intermediate point in an X or pantograph configuration, as illustrated.

Two angles 25*b* each having a fixed rotary shaft are positioned at the bottom right portion of each of the tray parts 2-1 through 2-3 and spaced from each other in the front-and-rear direction. Two angles 25*a* are positioned at the bottom left portion of each of the tray parts 2-1 through 2-3 and also spaced from each other in the front-and-rear direction. The angles 25 each is formed with a slot extending in the right-and-left direction. The angles 25*a* and 25*b* are formed by cutting and bending each of the tray parts 2-1 through 2-3. Two angles 26*b* each having a fixed rotary shaft are positioned on the inner right portion of the case 5A and spaced in the front-and-rear direction. Two angles 26*a* are positioned on the inner left portion of the case 5A and spaced from each other in the front-and-rear direction. The angles 26*a* each is formed with a slot extending in the right-and-left direction. Each link plate 22B is rotatably supported by the associated angle 25*b* and angle 26*a* while each link arm 23B is rotatably supported by the angel 25*a* and angle 26*b*. The link plate 22B and link arm 23B are smoothly slidable in the right-and-left direction via slide pins 27 relative to the angles 25*a* and 26*b*. The two link plates 22B and two link arms 23B assigned to each part of the tray 2 and spaced in the front-and-rear direction, as seen from the front, are rotatably supported by a single shaft 24B.

Figure 18B:
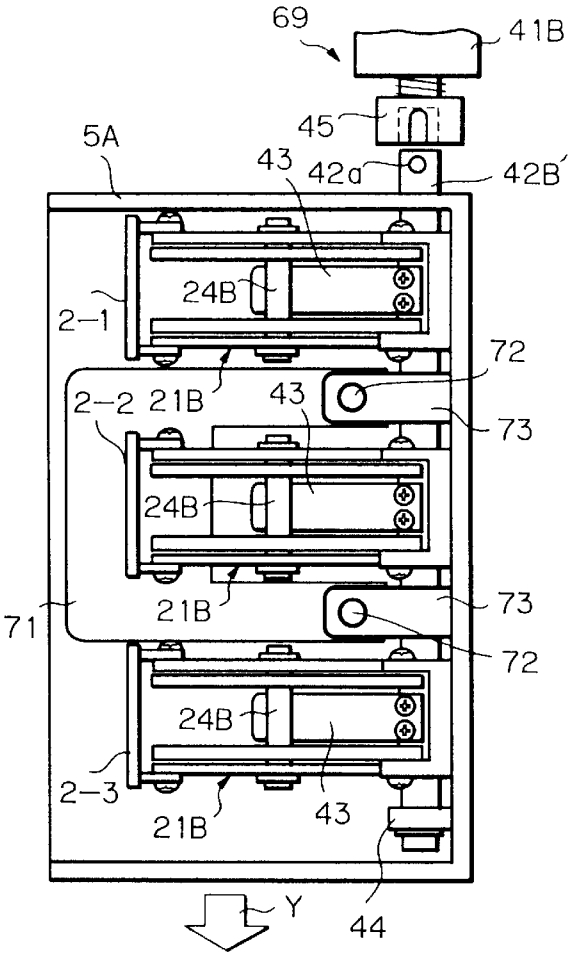
FIGS. 18A and 18B are respectively a fragmentary plan view and a fragmentary side elevation showing a second modification of the first embodiment.
Figure 18A:
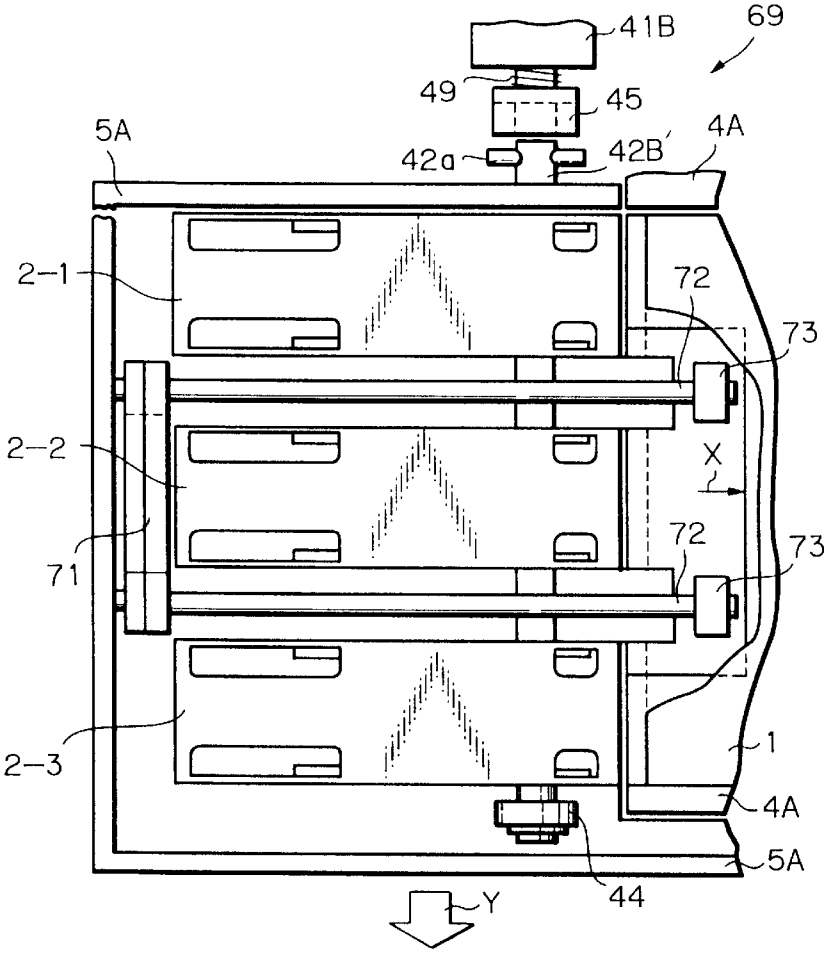

The angles 25*a* and 25*b* formed by machining the three tray parts 2-1 through 2-3 are shown in FIG. 18A showing a third modification of the illustrative embodiment, but not shown in the other figures.

The drive means 40B includes a reversible left stepping motor or drive source 41B affixed to the case 5A of the left tray 2. A drive shaft 42B is connected to the output shaft of the stepping motor 41B and extends in the front-and-rear direction. A lever 43 is fastened to the drive shaft 42B by a screw at one end and held in contact with the shaft 24B at the other end. The end of the drive shaft 42B remote from the motor 41B is rotatably supported by a bearing 44. When the papers P2 of relatively great size are stacked over the two trays 1 and 2 in a single stack, the motor 41B elevates the tray 2 in interlocked relation to the elevation of the tray 1 while maintaining the tray 2 substantially flush with the tray 1. For this purpose, a controller, not shown, sends a control command to a motor driver, not shown, which in turn sends drive pulses to the motor 41B. The motor 41B is capable of being controlled by open loop control, so that the upper and lower limit positions of the tray 2 can be sensed.

The left stepping motor 41B may be replaced with, e.g., a reversible DC motor. In such a case, sensors respectively responsive to the upper and lower limit positions of the left tray 2 should preferably be used from the elevation control standpoint.

Figure 7:
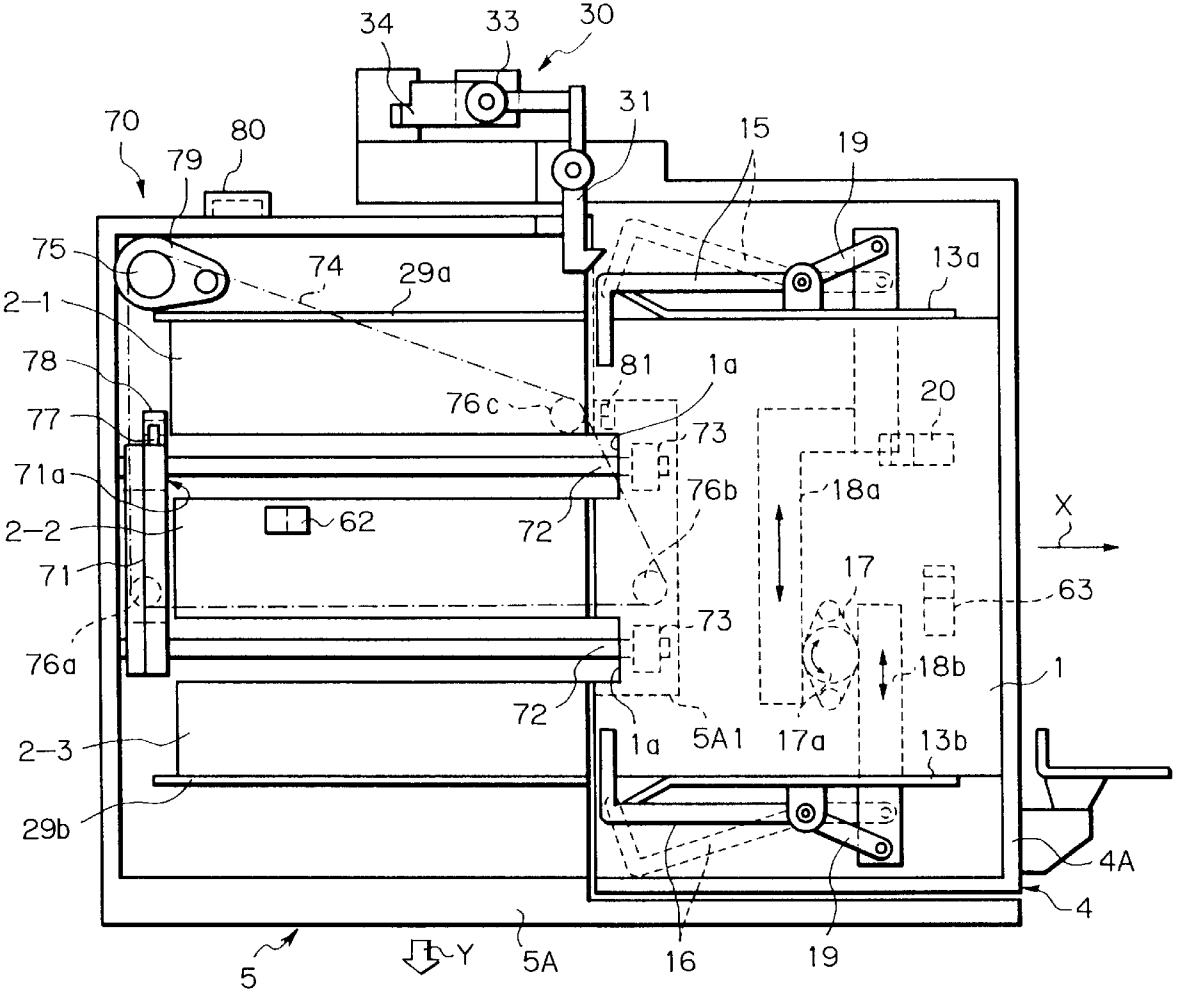
FIG. 7 is a fragmentary plan view of the upper paper feed section.

As shown only in FIG. 7, side fences 29*a* and 29*b* are respectively positioned on the rear part 2-1 and front part 23 of the left tray 2 for positioning the sides of the papers P1' or P2 which may be stacked on left tray 2. The side fences 29*a* and 29*b* are replaceable in matching relation to the paper size. The side fences 29*a* and 29*b* are respectively fastened to the tray parts 2-1 and 2-3 by screws or similar removable fastening means.

As shown in FIGS. 2, 4 and 7, the shifting means 70 is made up of an end fence 71 movable in the direction X in contact with the rear end of the paper stack P1' on the left tray 2, a pair of guide shafts or end fence guiding means 72 for guiding the end fence 71 to the vicinity of the right tray 1, and end fence drive means for moving the end fence 71.

Specifically, the end fence 71 is implemented as a molding of synthetic resin and provided with suitable reinforcement. The end fence 71 is configured such that in a tandem paper feed mode the fence 71 is capable of shifting the entire stack of at least 750 papers (plain papers) P1' from the left tray 2 to the right tray 1 in contact with the rear center of the stack P1'. To surely maintain the position of the end fence 71 constant, the fence 71 is guided by the two guide shafts 72 during the shift of the stack P1'. Each guide shaft 72 is affixed to the left wall of the case 5A at its left end. The right end of each guide shaft 72 is affixed to one of two support members 73 extending downward from an extension 5A1 extending from the case 5A in the direction X. The left end portion of the right tray 1 is formed with two notches 1*a* into which the right ends of the guide shafts 72 respectively protrude. In this configuration, the pressing surface 71*a* of the end fence 71 can surely shift the rear edge of the paper stack P1' to the rear edge of the paper stack P1 loaded on the right tray 1. An opening 71*b* is formed in the lower center portion of the end fence 71 for passing the center part 2-2 of the left tray 2.

As shown in FIG. 7, the end fence drive means includes a reversible DC motor or drive source 79. A drive pulley 75 is mounted on the output shaft of the DC motor 79. Three driven pulleys 76*a*, 76*b* and 76*c* are mounted on the bottom inner surface of the case 5A. A timing belt 74 indicated by a dash-and-dot line is passed over the drive pulley 75 and driven pulleys 76*a*–76*c*. The timing belt 74 is connected to the front lower extension of the end fence 71 by a connecting member not shown.

The DC motor 79 causes the drive pulley 75 to reversibly rotate with the result that the end fence 71 is moved back and forth along the guide shafts 72 via the timing belt 74 while remaining in a constant position. A home position sensor 78 responsive to the home position of the end fence 71 is mounted on the bottom inner surface of the case 5A and implemented by a transmission type photosensor. A lug 77 protrudes from the lower portion of one side of the end fence 71 and is selectively engageable with the home position sensor 78.

All the above constituents and driveline constituting the shifting means 70 are mounted on the case 5A of the left tray unit 5. Therefore, as shown in FIG. 3, when the left tray unit 5 is pulled out in the direction Y with the knob 5B held by hand, the shifting means 70 can be bodily pulled out in the direction Y. An electric connector 80 shown in FIG. 7 is mounted on the outside of the rear wall of the case 5A and connectable to an electric connector, not shown, mounted on the paper feeder frame 200F. This allows the electrical connection of the sensors 62 and 78 and DC motor 79 of the tray unit 5 to be freely set up.

For the shifting means 70 except for the guide shafts 72, use may be made of an arrangement including a reversible motor 30 and a worm gear, as shown in FIG. 2 of Japanese Patent Laid-Open Publication No. 5-124737 mentioned earlier.

The configuration of the right tray unit 4 will be described in detail hereinafter. As shown in FIGS. 2, 4, 6 and 7, the horizontal elevating means includes a parallel link mechanism 21A supporting the right tray 1 such that the tray 1 is movable up and down in a substantially horizontal position. The parallel link mechanism 21A is driven by drive means 40A.

The parallel link mechanism 21A is substantially identical with each parallel link mechanism 21B of the left tray unit 5 except that it has particular dimensions or strength matching with the papers to be supported. The mechanism 21A is therefore simply distinguished from the mechanism 21B by a suffix A added to the reference numerals 22, 23 and 24. The drive unit 40A is also substantially identical with the drive means 40B of the left tray unit 5 except for the operation timing. The drive unit 40A is therefore simply distinguished from the drive means 40B by the addition of a suffix A in place of the suffix B.

A pair of movable side fences 13*a* and 13*b* are respectively mounted on the front and rear of the right tray unit 4 for positioning the papers P1, P1' or P2 on the right tray 1 in the widthwise direction. A pair of movable back fences 15 and 16 are also respectively mounted on the front and rear of the tray unit 4 for stopping the rear edge of the paper stack P1 or P1', and each has a generally L-shaped configuration.

Figure 10:
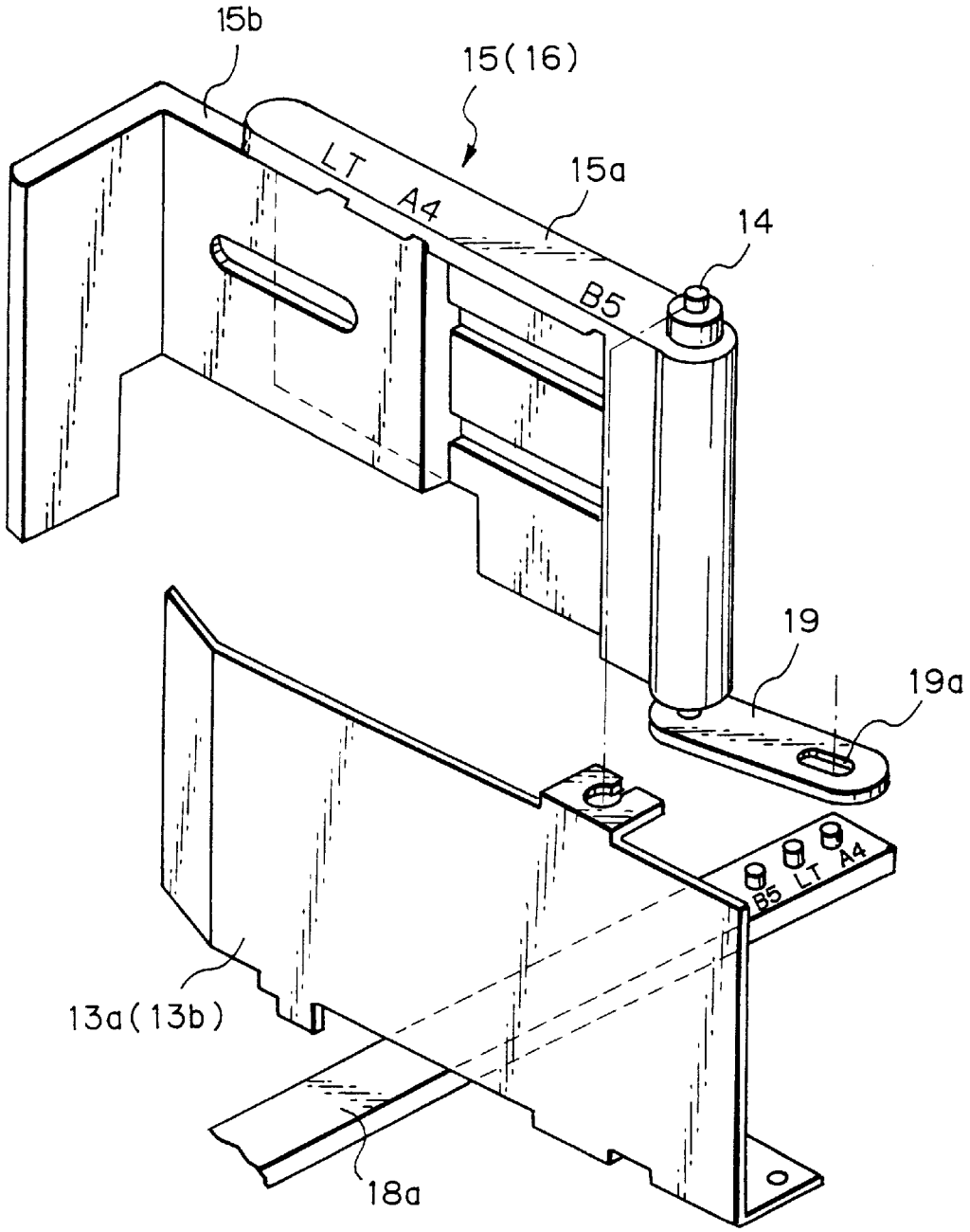
FIG. 10 is a perspective view showing a specific configuration of a back fence and a side fence associated with the right tray of the first embodiment.

As shown in FIGS. 7 and 10, the back fences 15 and 16 are respectively pivotably mounted on the side fences 13*a* and 13*b* by shafts 14. As shown in FIG. 10, the back fence 15 is made up of a back fence guide 15*a* and a back fence body 15*b*. For each paper size, the back fence body 15*b* is moved to a particular position along the back fence guide 15*a* and then fixed in place by a screw not shown, thereby coping with any paper size in the lengthwise direction. A connecting plate 19 is affixed to the bottom of the back fence guide 15*a*. The back fence 16 is identical in configuration with the back fence 15.

As shown only in FIG. 7, a stepping motor 17 is mounted on the bottom of the right tray unit 4 for driving the back fences 15 and 16. Specifically, a pinion 17*a* is mounted on the output shaft of the motor 17 and held in mesh with racks 18a and 18*b*. A home position sensor 20 is positioned below the rack 18*a* for sensing the home positions of the back fences 15 and 16. The back fences 15 and 16 each positions the rear edge of the paper stack P1 loaded on the tray 1 or that of the paper stack P1' brought to the tray 1 by the shifting means 70, as indicated by solid lines in FIG. 7.

A boss is formed at one end of the rack 18*a* and received in a slot 19*a* formed in the connecting plate 19, thereby connecting the back fence 15 to the rack 18*a*. Specifically, a plurality of bosses each being assigned to a particular paper size are formed on the rack 18*a* and selectively received in the slot 19*a*. Of course, the bosses of the rack 18*a* and the slot 19*a* of the connecting plate 19 may be replaced with each other. The back fence 16 and rack 18*b* are connected together in exactly the same configuration as the back fence 15 and rack 18*b*.

Figure 5:
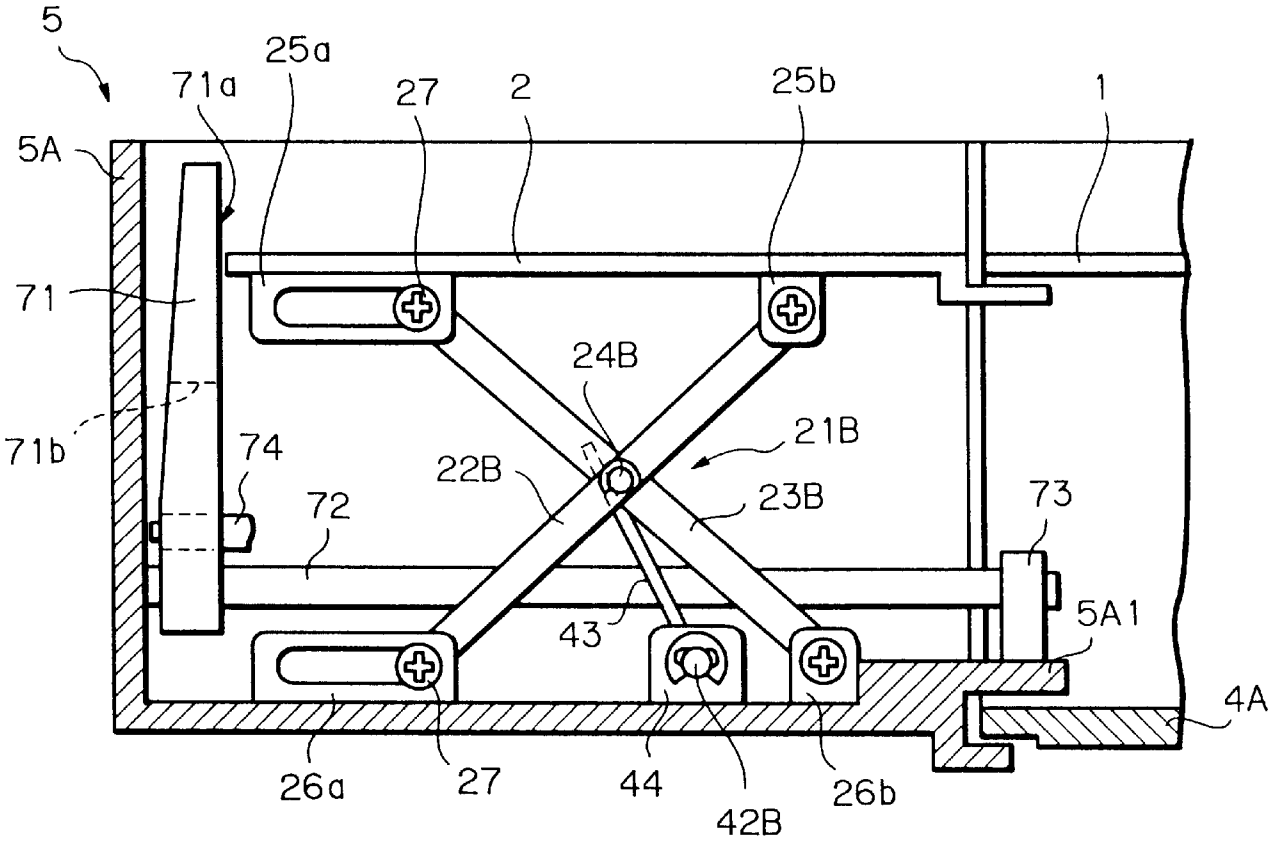
FIG. 5 is a fragmentary section showing a left tray unit included in the first embodiment together with an arrangement around the left tray unit.

The above mechanism for moving the back fences 15 and 16 may be replaced with, e.g., an arrangement including a rotary solenoid 18 with a pin 18-2 and a torsion spring 17, as shown in FIG. 5 of Japanese Patent Laid-Open Publication No. 5-124737. Such an alternative arrangement features rapid response and rapid return.

As shown in FIG. 7, a paper sensor 63 is located at a preselected position on the right tray 1 for sensing the paper stack P1 or P1' on the tray 1. The paper sensor 63 is implemented by a reflection type photosensor.

Figure 8:
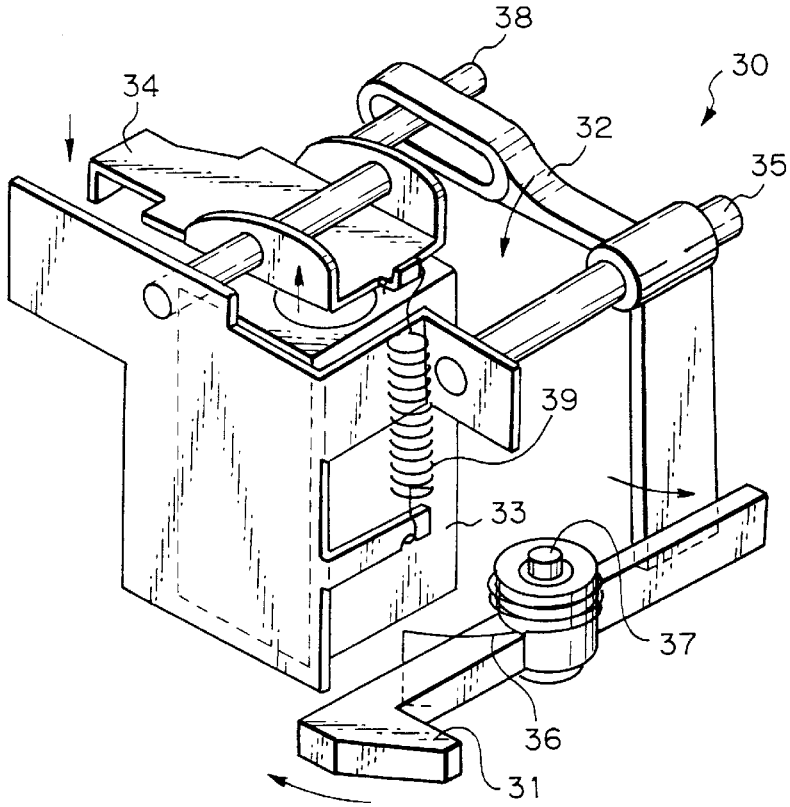
FIG. 8 is a perspective view showing a locking mechanism included in the first embodiment.

A locking mechanism 30 for selectively connecting or disconnecting the right tray unit 4 and left tray unit 5 is shown in FIGS. 7–9B. As shown, the locking mechanism 30 includes a push type DC solenoid or drive source 33 affixed to the paper feeder frame 200F. A second lock pawl 34 is affixed to the actuator portion of the solenoid 33 at its base end and angularly movable up an down at its free end. The second lock pawl 34 is engageable with the case 4A of the right tray unit 4. A tension spring 39 is anchored to the base end of the second lock pawl 34 and constantly biases the pawl 34 away from the case 4A. A stud 38 is affixed to the second lock pawl 34. An arm 32 is connected to the stud 38 and angularly movable about a stud 35 in a direction indicated by an arrow and in the opposite direction. A first lock pawl 31 is rotatable about a shaft 37 with its one end adjoining the lower end of the arm 32. The first lock pawl 31 is engageable with a notch 5*a* formed in the case 5A of the left tray unit 5. A torsion coil spring 36 is anchored to the shaft 37 at one end and to the first lock pawl 31 at the other end, so that the lock pawl 31 tends to engage with the notch 5*a*. The locking mechanism 30 may be replaced with a locking mechanism including a lock pawl 32 and an unlock solenoid 31, as shown in FIGS. 7 and 8 of Japanese Patent Laid-Open Publication No. 5-124737 mentioned earlier.

Figure 11:
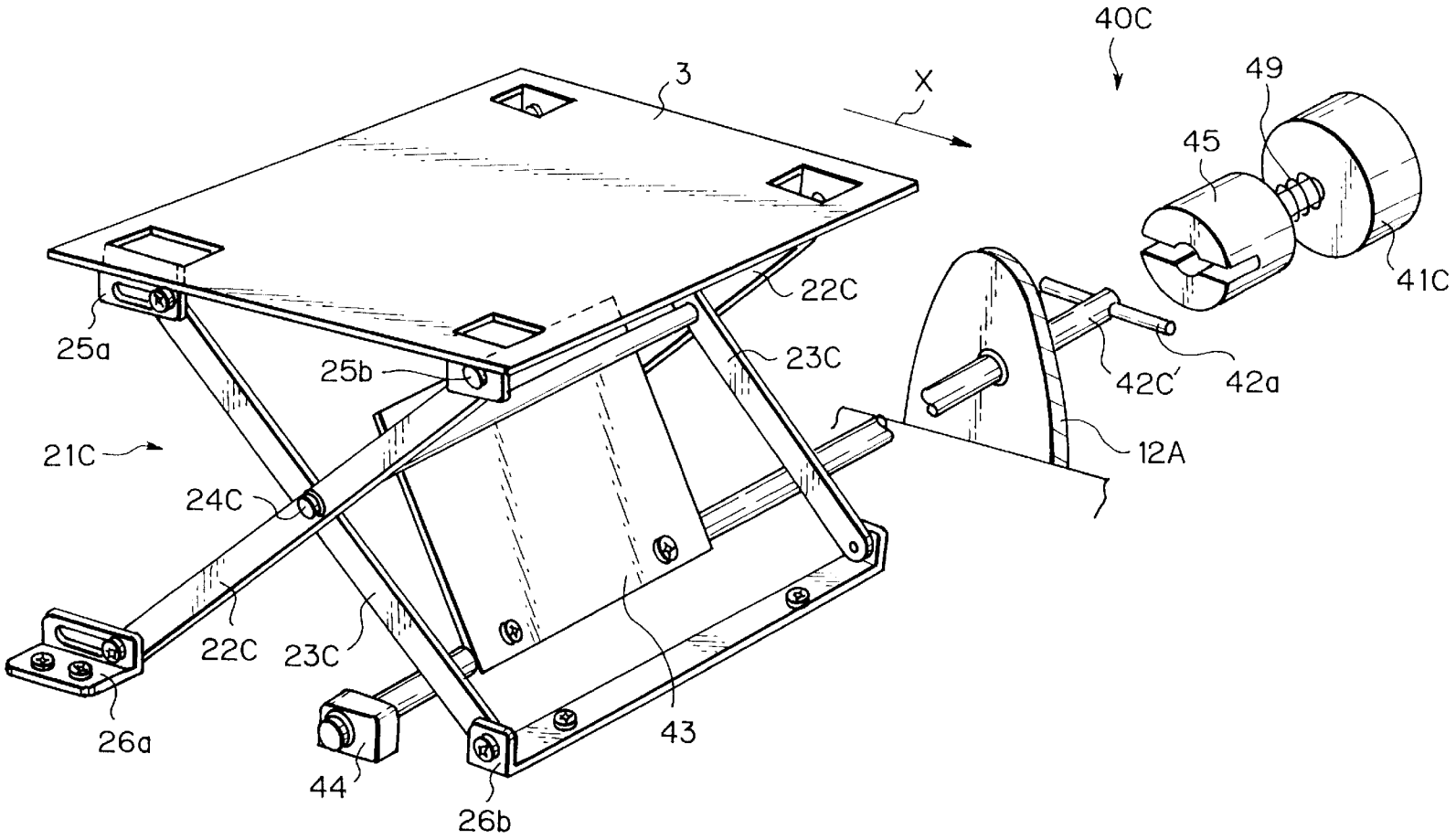
FIG. 11 is a fragmentary perspective view showing a bottom tray unit also included in the first embodiment, an arrangement around the bottom tray unit, and drive means.

The configuration of the bottom tray unit 12 will be described in detail hereinafter. As shown in FIGS. 2 and 11, the tray supporting means is implemented by members 11 protruding from respective brackets extending from the bottom inner surface of the paper feeder frame 200F. Slide rails 10 each having a generally U-shaped section are respectively formed on the outer surfaces of opposite walls of the bottom tray unit 12. The members 11 each is loosely received in one of the slide rails 10. In this condition, the bottom tray unit 12 is supported by the members 11 and can be pulled out of the paper feeder frame 200B in the forward direction Y, as viewed in FIG. 2, perpendicular to the paper feed direction X.

A paper sensor 59 is mounted on the paper feeder frame 200F above the bottom tray 3. The paper sensor 59 senses the top of the papers P2 of relatively great size stacked on the tray 3 and determines whether or not such papers P2 are present. The paper sensors 54, 58 and 59 each is implemented by a transmission type photosensor including an angularly movable feeler. The sensors 45, 58 and 59 each senses the top paper with its feeler contacting the top paper.

When the tray associated with any one of the paper sensors 54, 58 and 59 runs out of the papers, the feeler of the paper sensor enters a slot formed in the tray, causing the sensor to determine that the papers are absent.

As shown in FIGS. 2 and 11, the horizontal elevating means includes a parallel link mechanism 21C supporting the bottom tray 3 such that the tray 3 is movable up and down in substantially the horizontal position. Drive means 40C causes the parallel link mechanism 21C to move up and down. The parallel link mechanism 21C is substantially identical in configuration with the parallel link mechanism 21A of the right tray unit 4 except for dimensions implementing strength great enough to support the papers. The mechanism 21C is therefore simply distinguished from the mechanism 21A by the addition of a suffix C.

The drive means 40C is similar to the drive means 40A of the right tray unit 4 except for the following. A reversible DC motor 41C is mounted on the paper feeder frame 200F in place of the stepping motor 41 A mounted on the case 4A of the right tray unit 4. A drive shaft 42 including a pin 42*a* is substituted for the drive shaft 42A. The pin 42*a* is removably engaged with a coupling 45 connected to the output shaft of the DC motor 41C. A compression spring 49 is wound round the output shaft of the DC motor 41C.

A specific operation of the illustrative embodiment will be described with reference to FIGS. 2, 7, 12 and 13. The following description will concentrate on the upper paper feed section 201 unique to the illustrative embodiment for the simplicity of description. The operation of the lower paper feed section 202 will be easily understood by analogy. A procedure to be described is effected by a controller, not shown, including a microcomputer. A CPU (Central Processing Unit) outputs a command for causing the procedure to be executed in accordance with a program of FIGS. 12 and 13 stored in a ROM (Read Only Memory).

Figure 12A:
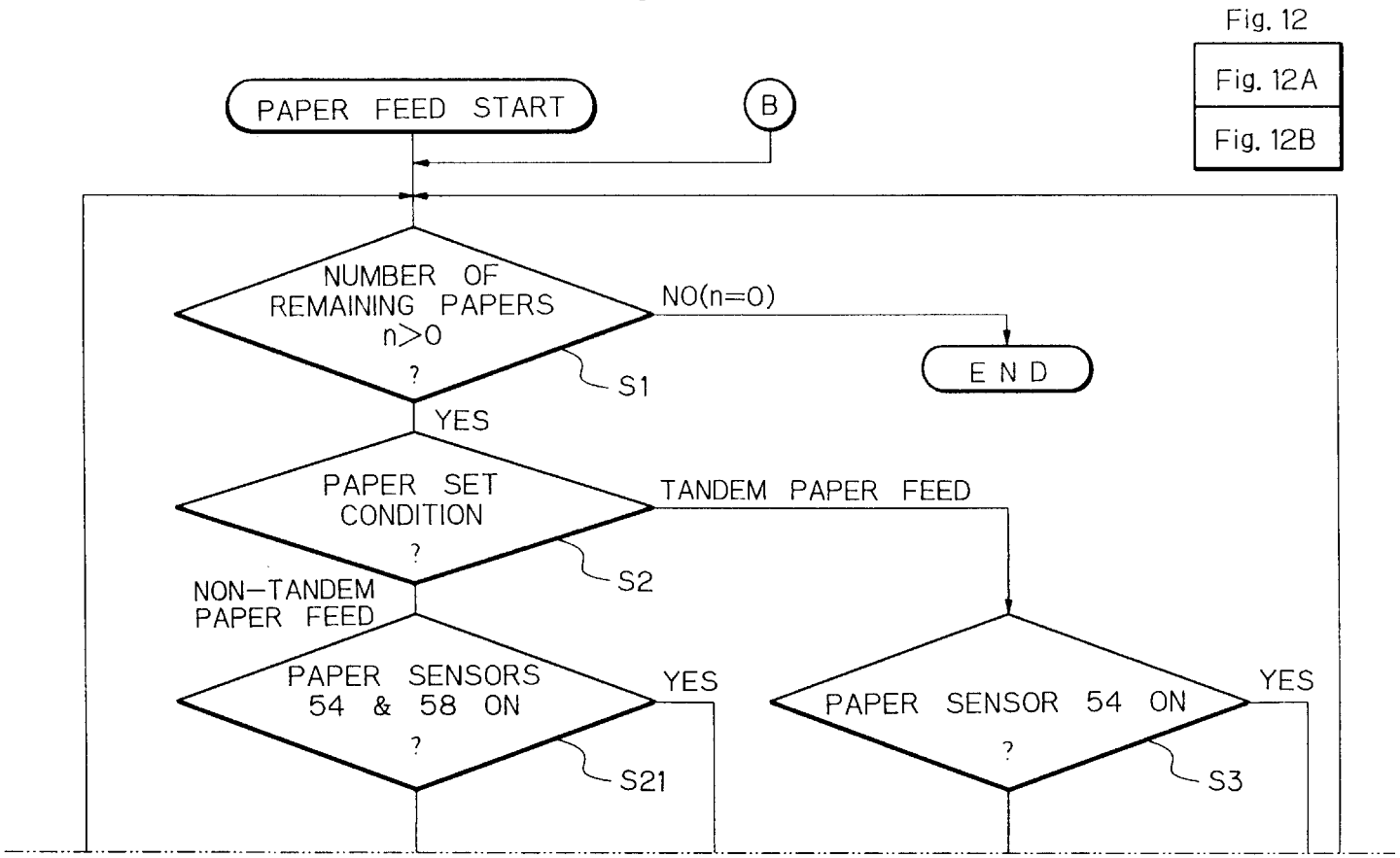
FIGS. 12 and 13 are flowcharts demonstrating a specific operation of the first embodiment.
Figure 12B:
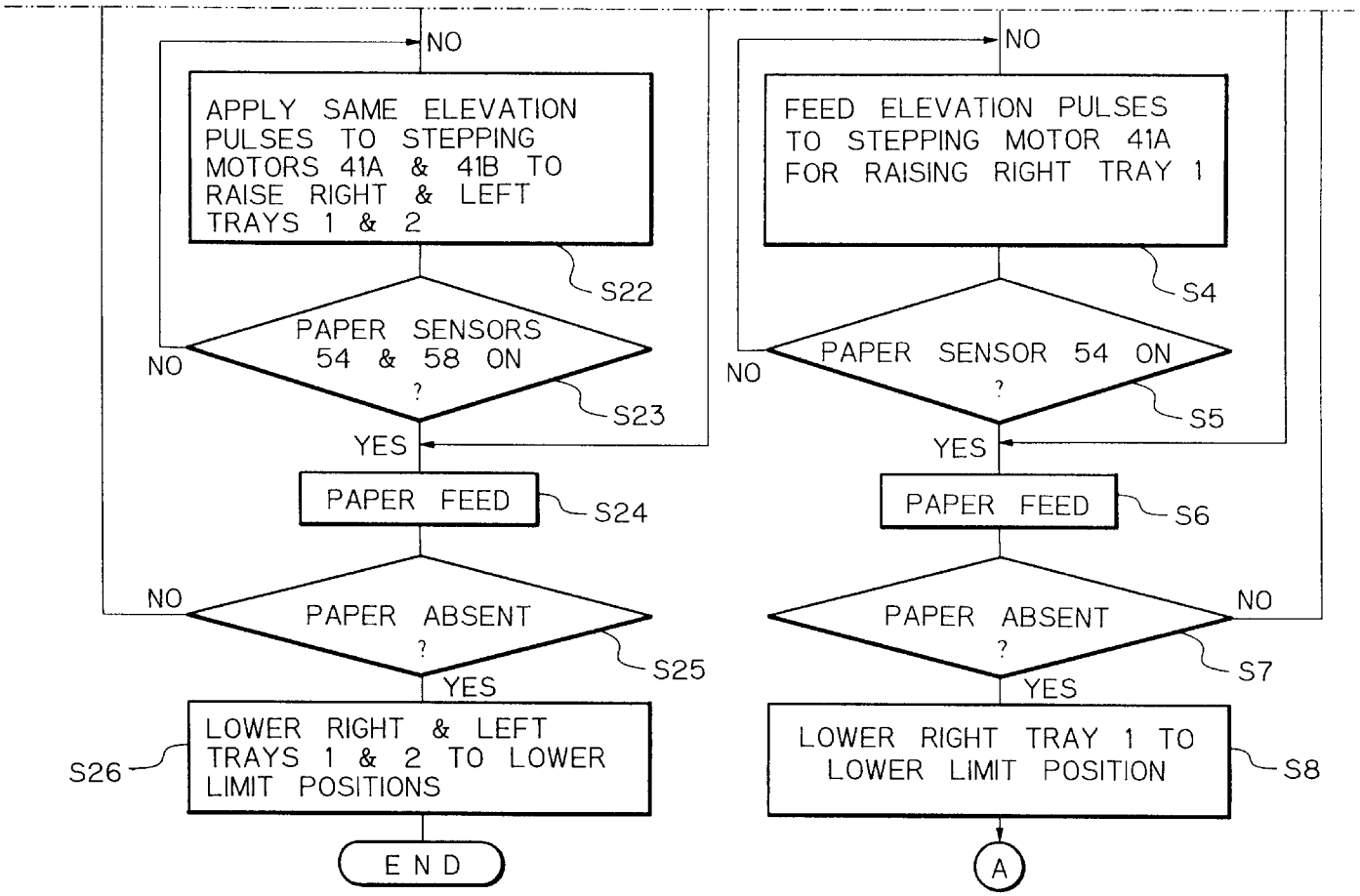

As shown in FIG. 12, the controller determines the number n of remaining papers available for the desired number of printings input on numeral keys arranged on an operation panel not shown (n>0) (step S1). If one or more papers are left (YES, step S1), the controller determines a condition wherein papers are set in the upper paper feed section 201 (step S2). If papers of relatively small size are stacked on each of the two trays 1 and 2, as determined by size sensors, not shown, then the controller sets up a tandem paper feed mode. If a single stack of papers of relatively great size is sensed, then the controller sets up a non-tandem paper feed mode.

In the tandem paper feed mode, the controller determines, based on the output of the paper sensor 54, whether or not the top of the stack P1 on the right tray 1 is held in a preselected paper feed position where the papers P1 can be fed by the pick-up roller 51 (step 3). Specifically, if the paper sensor 54 is in its ON state, showing that the papers P1 are ready to be fed (YES, step S3), then the controller executes a step S6; if otherwise, the controller executes a step S4.

In the step S4, the controller causes the right tray 1 to rise on the basis of a command output from the CPU. Specifically, forward drive pulses (ELEVATION PULSES) are applied to the right stepping motor 41A for elevating the right tray 1. As a result, the parallel link mechanism 21A is raised via the drive means 40A until the top of the paper stack P1 reaches the paper feed position, as determined by the paper sensor 54 (step S5). If the answer of the step S5 is YES, then the controller executes the paper feed operation (step S6).

During paper feed operation, controller constantly determines whether or not the papers P1 are present on the basis of the output of the paper sensor 54. When the papers P1 are absent (YES, step S7), reverse drive pulses are applied to the stepping motor 41A for lowering the right tray 1 in response to a command output from the CPU. As a result, the parallel link mechanism 21A is lowered via the drive means 40A until the right tray 1 has been lowered to its lower limit position (step S8).

Figure 13:
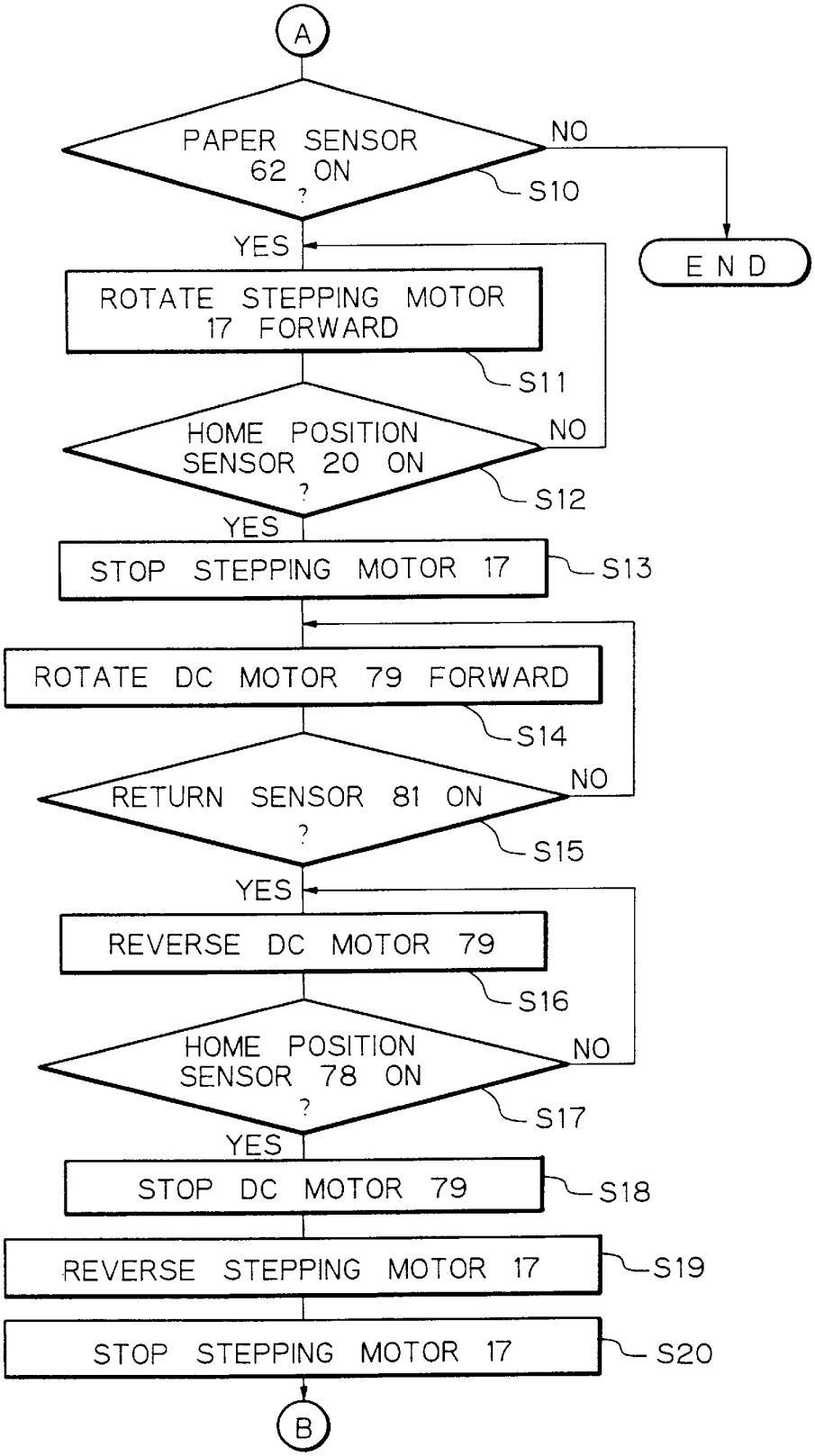

The above step S8 is followed by a step S10 shown in FIG. 13. In the step S10, the controller determines whether or not the papers P1' are present on the left tray 2 on the basis of the output of the paper sensor 62. If the papers P1' are absent, i.e., if the paper sensor 62 is in its OFF state (NO, step S10), then the controller displays a message representative of the absence of the papers P1' on the operation panel, urging the operator to replenish papers. If the answer of the step S10 is positive (YES), then the controller causes the stepping motor 17 to rotate forward and thereby causes the racks 18*a* and 18*b* to move toward each other via the pinion 17*a*. As a result, the back fences 15 and 16 having stopped the rear edge of the stack P1 are instantaneously retracted to positions indicated by dashed lines in FIG. 7, guaranteeing an area for the shift of the stack P1' (step S11).

When the angled portion of the rack 18*a* is sensed by the home position sensor 20 (YES, step S12), the controller stops driving the stepping motor 17 (step S13) and maintains the back fences 15 and 16 in the dashed line positions of FIG. 17.

Subsequently, the controller causes the DC motor 79 to rotate forward (step S14). The DC motor 79, in turn, causes the drive pulley 75 to rotate forward. As a result, the end fence 71 is moved toward the right tray 1 via the timing belt 74 while being held in a preselected position by the guide shafts 72 and pushing the rear edge of the paper stack P1'. When a return sensor 81 senses the lug 77 of the end fence 71 (YES, step S15), the controller determines that the shift of the paper stack P1' has ended. Then, the controller automatically interrupts the rotation of the DC motor 79 and causes it to rotate in the reverse direction (step S16). Consequently, the end fence 71 is returned toward its home position.

When the home position sensor 78 senses the end fence 71 brought to its home position (YES, step S17), the controller stops the reverse rotation of the DC motor 79 (step S18). Subsequently, the controller causes the stepping motor 17 to rotate in the reverse direction by a preselected number of pulses (step S19). As a result, the back fences 15 and 16 are again moved from their retracted positions or home positions to the solid line positions of FIG. 7 for stopping the rear edge of the paper stack P1'. Then, the controller stops the rotation of the stepping motor 17 (step S20) and returns to the step S1, FIG. 12.

The non-tandem mode operation unique to the illustrative embodiment is as follows. In the non-tandem mode set up in the step S2, FIG. 12, the controller determines, based on the outputs of the papers sensors 54 and 58, whether or not the top of the paper stack P2 of relatively great size and extending over the two trays 1 and 2 is held in the paper feed position mentioned earlier (step S21). If the answer of the step S21 is YES, then the controller executes the paper feed operation (step S24). If the answer of the step S21 is NO, then the controller causes the left tray 2 to rise in interlocked relation to the elevation of the right tray 1 (step S22). Specifically, forward drive pulses (ELEVATION PULSES) are applied to the right stepping motor 41A for raising the right tray 1. At the same time, forward drive pulses are applied to the left stepping motor 41B for raising the left tray 2. As a result, the parallel link mechanisms 21A and 21B are elevated via the drive means 40A and 40B, respectively, uniformly raising the top of the paper stack P2 extending over the trays 1 and 2. As soon as the top of the paper stack P2 reaches the paper feed position (YES, step S23), the controller executes the paper feed operation (step S24).

As stated above, in the non-tandem paper feed mode, the papers P2 extending over the trays 1 and 2 can be stably fed while being held in substantially the horizontal position. The papers P2 are therefore free from deformation and paper jam and other troubles discussed earlier.

A fifth embodiment to be described later and using a wire type elevation mechanism is capable of elevating a greater number of papers P (more than 1,000 papers of size A3). However, the wire type elevation mechanism has the following problems. First, the mechanism is limited in space due to its structure. Second, the wire stretches due to aging and must have its tension adjusted. Third, a structure for arranging the wire is complicated. Fourth, the mechanism needs a number of parts.

The first embodiment solves the above problems by use of the parallel link mechanisms 21A, 21B and 21C and allows a relatively great number of papers P (about 1,000 papers of size A3) to be elevated. In addition, the horizontal elevation mechanism can be implemented with the simplest structure.

Referring again to FIG. 12, during paper feed operation, the controller constantly determines whether or not the papers P2 extending over the trays 1 and 2 are present on the basis of the outputs of the paper sensors 54 and 58. When the papers P2 are absent (YES, step S25), then reverse drive pulses are applied to the stepping motors 41A and 41B for lowering the trays 1 and 2 in response to a command output from the CPU. Consequently, the parallel link mechanisms 21A and 21B are lowered via the drive means 40A and 40B, respectively, until the trays 1 and 2 have been lowered to their lower limit positions (step S26).

Figure 9A:
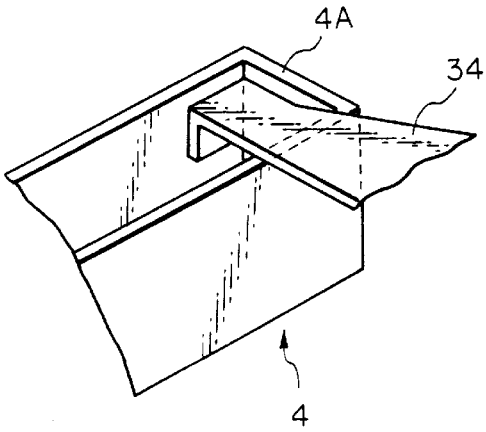
FIGS. 9A and 9B are perspective views demonstrating the operation of the locking mechanism.

The operation of the locking mechanism 30 is as follows. Assume that the papers P1, P1' or P2 are held at the paper feed position on the right tray 1 during paper feed operation. Then, in FIG. 8, the DC solenoid 33 is in its ON state with the actuator portion protruding upward as indicated by an arrow. The second lock pawl 34 is therefore held in its lowered position against the action of the tension spring 39. In this condition, as shown in FIG. 9A, the second lock pawl 34 locks the right tray unit 4. The case 4A of the right tray unit 4 is therefore locked to the paper feeder frame 200F and cannot be pulled out in the direction Y.

In the above condition, the arm 32 connected to the second lock pawl 34 is angularly moved about the stud 35 in the direction indicated by an arrow. In this position, the angled lower end of the arm 32 is engaged with one end of the first lock pawl 31 of the right tray unit 4. As a result, the first lock pawl 31 having been engaged with the notch 5*a* of the left tray unit 5 is rotated about the shaft 37 against the action of the torsion coil spring 36, as indicated by an arrow. This unlocks the left tray unit 5 from the paper feeder frame 200F and allows only the left tray unit 5 to be pulled out, as shown in FIG. 3. That is, while printing operation is under way, only the left tray unit 5 can be pulled out in the direction Y and replenished with papers P1'.

Figure 9B:
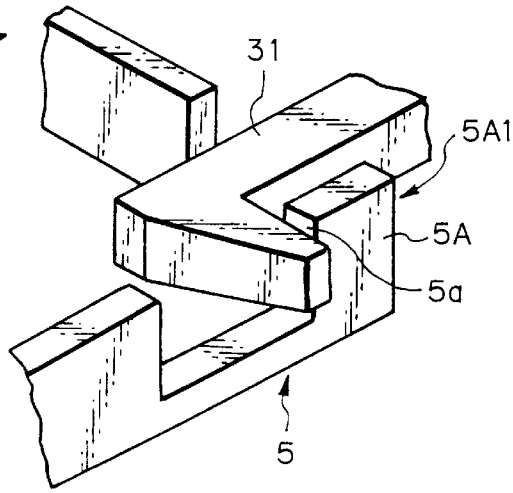

When printing operation is not under way, the DC solenoid 33 is held in its OFF state. The second lock pawl 34 is raised by the spring 39 in the direction opposite to the direction indicated by the arrow, unlocking the right tray unit 4. The arm 32 connected to the second lock pawl 34 is rotated about the stud 35 in the direction opposite to the direction indicated by the arrow. As a result, the lower end of the arm 32 and one end of the first lock pawl 31 are released from each other. The first lock pawl 31 locks the left tray unit 5 due to the action of the torsion coil spring 36, as shown in FIG. 9B, and thereby connects the right tray unit 4 and left tray unit 5. In this condition, the right tray unit 4 and left tray unit 5 can be pulled out together without damaging the papers P1, P1' or P2 or the shifting means 70.

Assume that a jam or similar trouble occurs during replenishment of the papers P1' into the left tray unit 5 pulled out in the direction Y alone, causing the printer to stop operating. Then, the DC solenoid 33 is automatically deenergized by, e.g., a command output from the controller, so that the right tray unit 4 is unlocked. This allows the operator to pull out the right tray unit 4 in the direction Y by holding a knob, not shown, provided on the case 4A and then deal with the trouble.

Figure 17A:
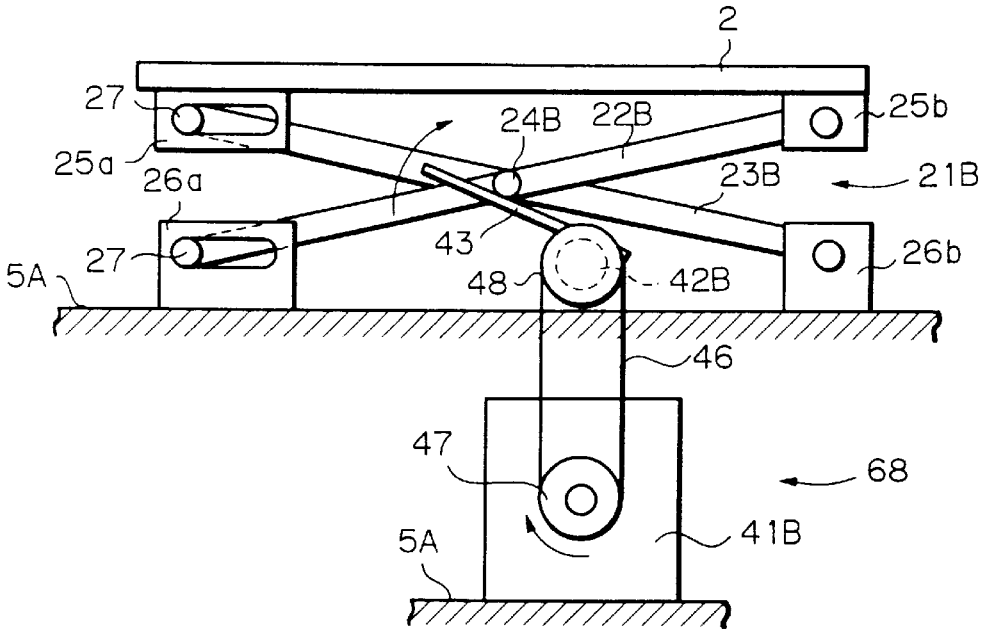
FIGS. 17A and 17B are front views showing a first modification of the first embodiment.
Figure 17B:
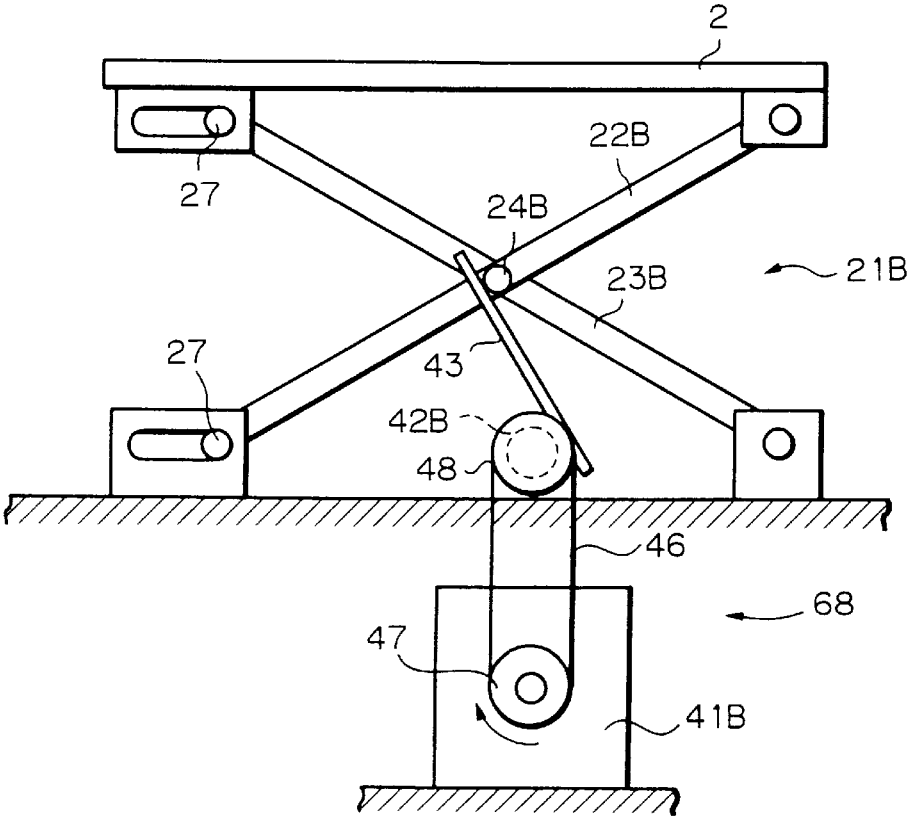

FIGS. 17A and 17B show a first modification of the above embodiment. In FIGS. 17A and 17B, the angles 25*a*, 25*b*, 26*a* and 26*b* and slide pin 27 each is shown in a simplified form. As shown, the first modification differs from the embodiment in that it includes drive means 68 in place of the drive means 40B. While the drive means 40B includes the left stepping motor 41B directly connected to the drive shaft 42B of the lever 43, the drive mans 68 includes a timing belt 46 passed over a drive pulley 47 and a driven roller 48. The drive pulley 47 and driven pulley 48 are affixed to the output shaft of the left stepping motor 41B and the drive shaft 42B, respectively.

In operation, when the left stepping motor 41B is driven in, e.g., the forward direction, the timing belt 46 is rotated counterclockwise, as viewed in FIG. 17A. As a result, as shown in FIG. 17B, the driven shaft 42B rotates clockwise and causes the lever 43 to rotate clockwise. Consequently, the shaft 24B and therefore the left tray 2 is elevated. When the stepping motor 41B is rotated in the reverse direction, the left tray 2 is lowered via the above mechanism.

As stated above, the first embodiment and its first modification each includes the X-shaped parallel link mechanisms 21A, 21B and 21C and therefore implements a parallel elevation mechanism with the simplest structure. In addition, the above mechanisms respectively moving the trays 1, 2 and 3 up and down in engagement with the shafts 24A, 24B and 24C each implements the torque for the X-shaped links most efficiently when the number of papers is maximum, i.e., when the X-shaped links are most contracted in the up-and-down direction. The paper feeder therefore achieves a high driving efficiency in the design aspect.

FIGS. 18A and 18B show a second modification of the first embodiment. As shown, the second modifications differs from the first embodiment in that drive means 69 is substituted for the drive means 40B. In the drive means 69, the left stepping motor 41B is affixed to the paper feeder frame 200F. A drive shaft 42B' with a pin 42*a* is substituted for the drive shaft 42B. The pin 42*a* is removably engaged with the coupling 45 connected to the output shaft of the stepping motor 41B.

Figure 19B:
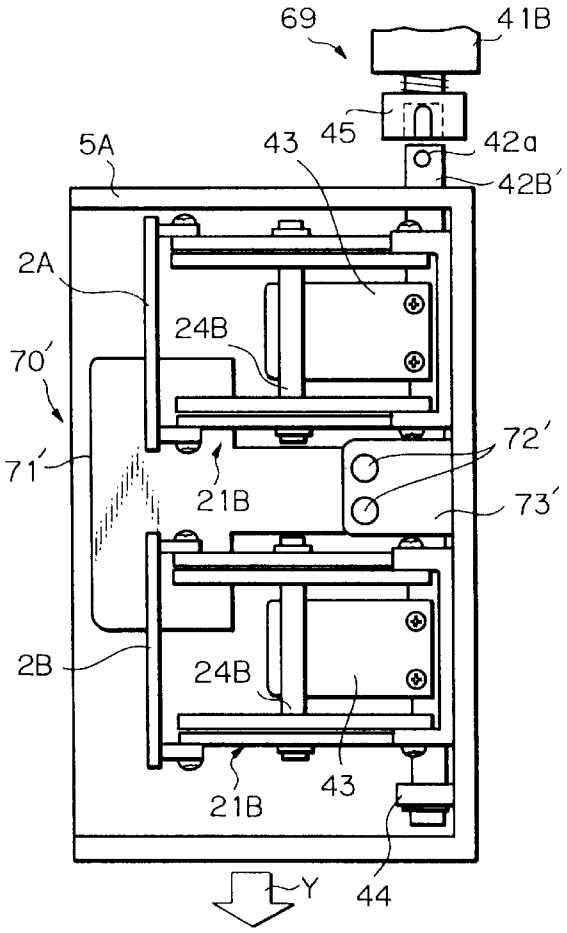
FIGS. 19A and 19B are respectively a fragmentary plan view and a fragmentary side elevation showing a third modification of the first embodiment.
Figure 19A:
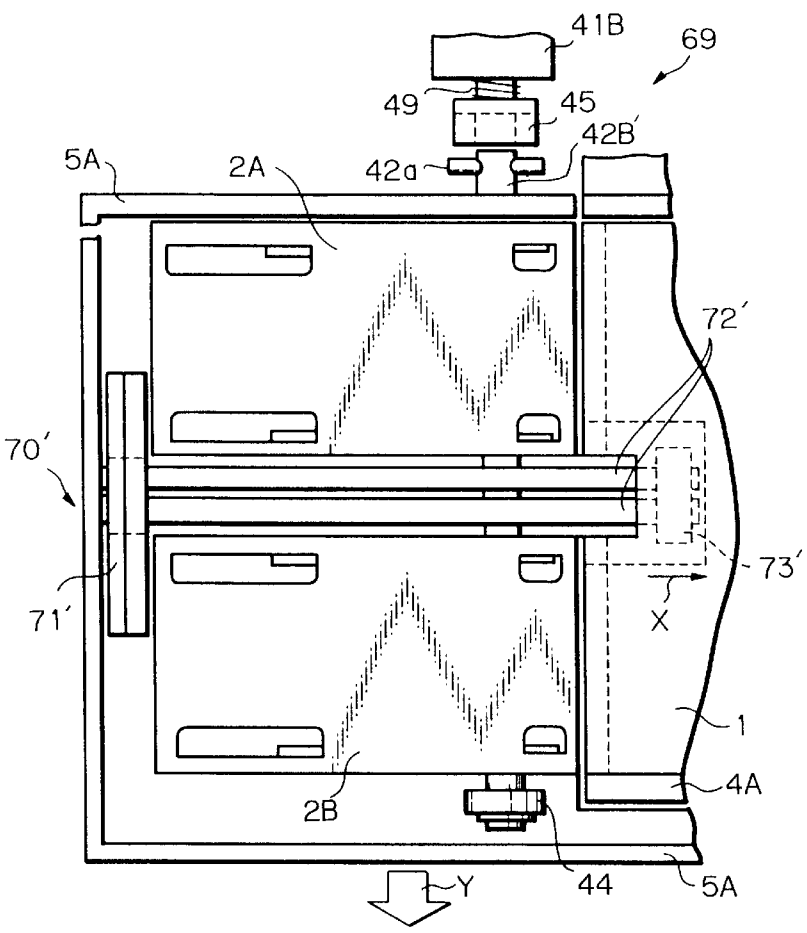

FIGS. 19A and 19B show a third modification of the first embodiment. As shown, the third modification differs from the first embodiment in that shifting means 70' is substituted for the shifting means 70, and in that the left tray 2 is made up of two parts 2A and 2B. The shifting means 70' includes an end fence 71' having a single leg and two guide shafts 72' in place of the end fence 71, guide shaft 72 and support member 73 of the shifting mans 70. The guide shafts 72 are supported by a single support member 73'.

2nd Embodiment

Figure 14:
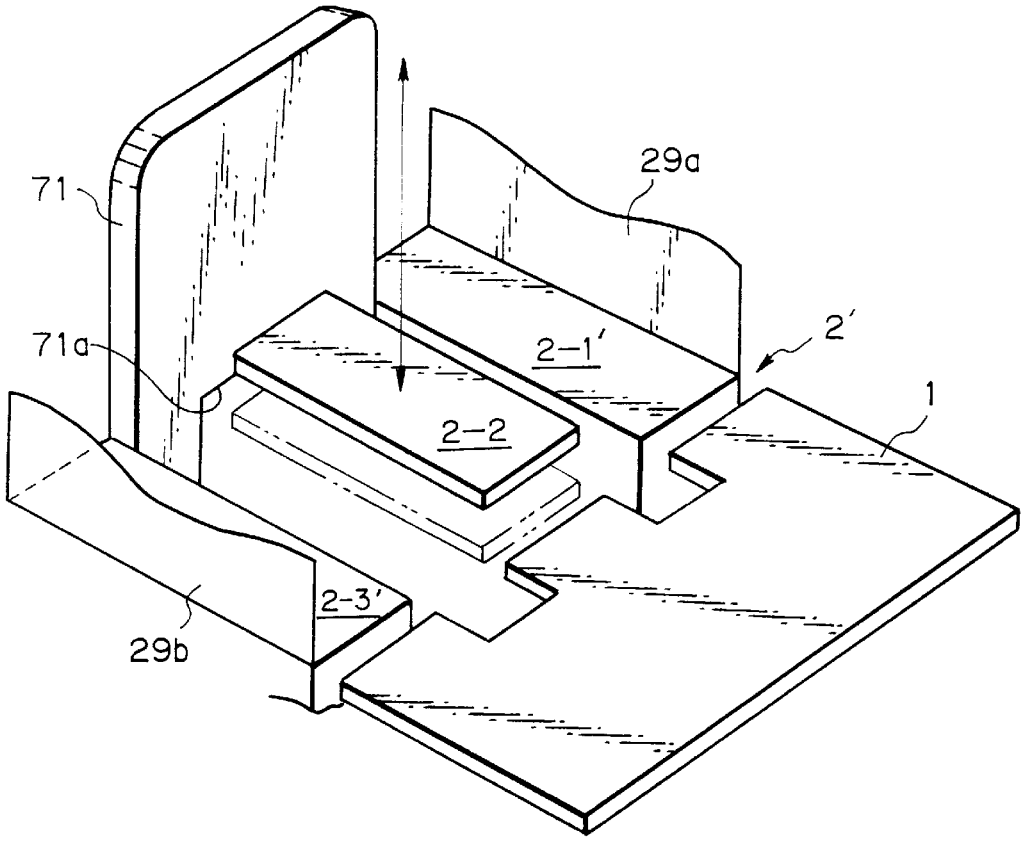
FIG. 14 is a fragmentary perspective view showing a left tray representative of a second embodiment of the present invention.
Figure 15:
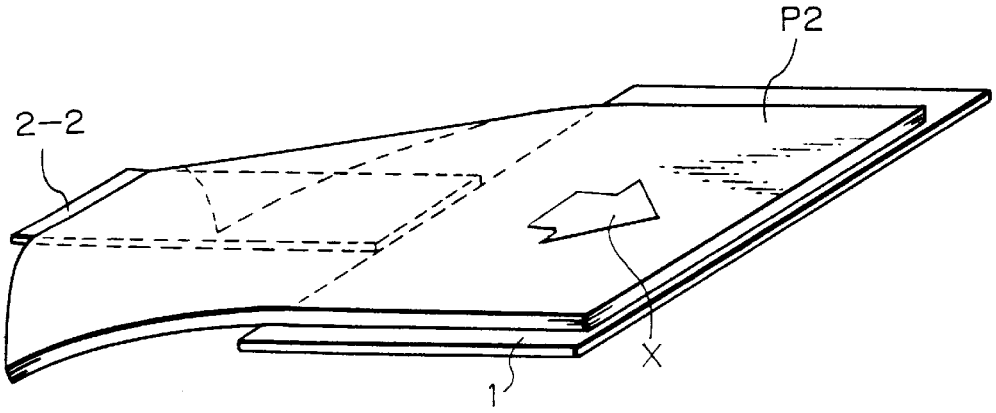
FIG. 15 is a perspective view showing how papers are stacked in a non-tandem mode in the second embodiment.

As shown in FIG. 14, a second embodiment of the present invention includes a left tray 2' consisting of three parts 2-1', 2-2 and 2-3'. In the left tray 2', only the center part 2-2 is moved up and down by the interlocking means. In this embodiment, therefore, the papers P2 of relatively great size are stacked on the trays 1 and 2' in the condition shown in FIG. 15. Although the rear side edge portions of the papers P2 hand down, the papers P2 can be fed with the top of the front part and that of the rear part remaining substantially flush with each other. This is also successful to prevent the portion of the stack P2 contacting the pick-up roller 51 from deforming and therefore to insure the stable feed of the papers P2.

3rd Embodiment

Figure 16A:
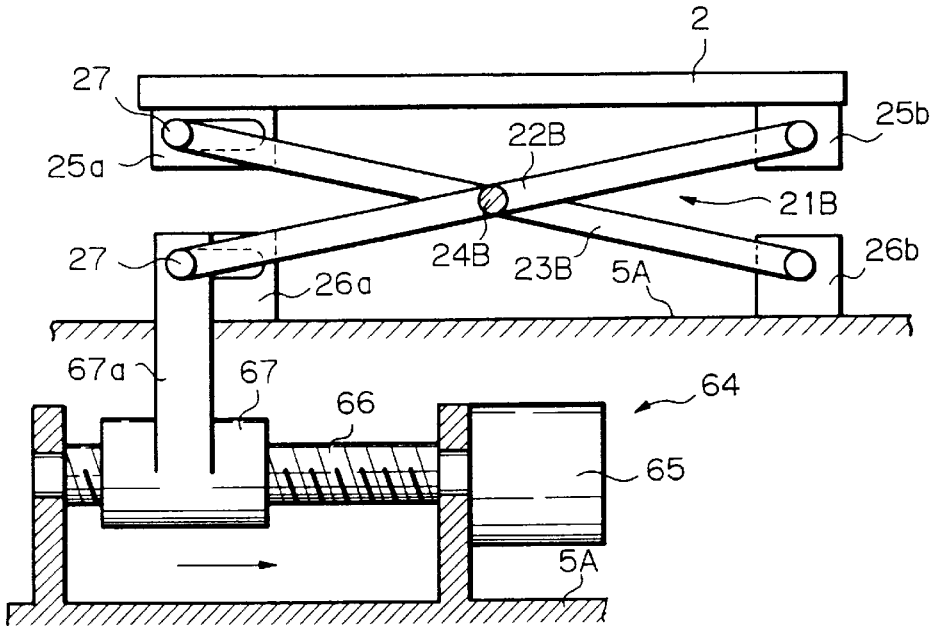
FIGS. 16A and 16B are front views showing a third embodiment of the present invention.
Figure 16B:
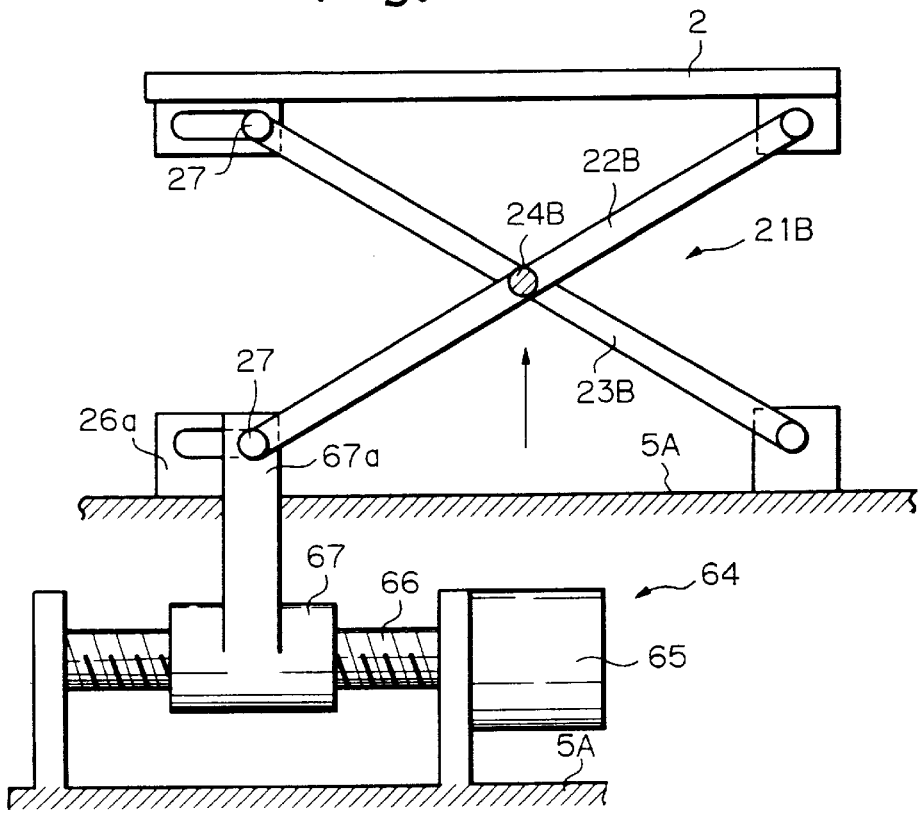

FIGS. 16A and 16B show a third embodiment of the present invention. In FIGS. 16A and 16B, the angles 25*a*,

25*b*, 26*a* and 26*b* each is shown in a simplified form. This embodiment differs from the first embodiment in that drive means 64 is substituted for the drive means 40B and constructed to move the left tray 2 up and down in engagement with the slide pin 27 of one link plate 22B. Specifically, the drive means 64 includes a reversible DC motor or drive source 65 mounted on a bracket which is mounted on the case 5A of the left tray unit 5. A ball screw 66 is connected to the output shaft of the DC motor 65 and rotatably supported by the above bracket and another bracket mounted on the case 5A. A movable member 67 is formed with a female screw meshing with the ball screw 66 and is connected to the slide pin 27 of the link plate 22B. A connecting portion 67*a* protrudes from the movable member 67 and connected to the slide pin 27.

In operation, when the DC motor 65 is rotated in, e.g., the forward direction, the ball screw 66 is also rotated in the forward direction. As a result, as shown in FIG. 16A, the movable member 67 meshing with the ball screw 66 is moved in a direction indicated by an arrow, moving the slide pin 27 in the same direction. Consequently, as shown in FIG. 16B, the left tray 2 is raised in the horizontal position. When the DC motor 65 is reversed, the left tray 2 is lowered in the horizontal position via the above mechanism.

4th Embodiment

Figure 20:
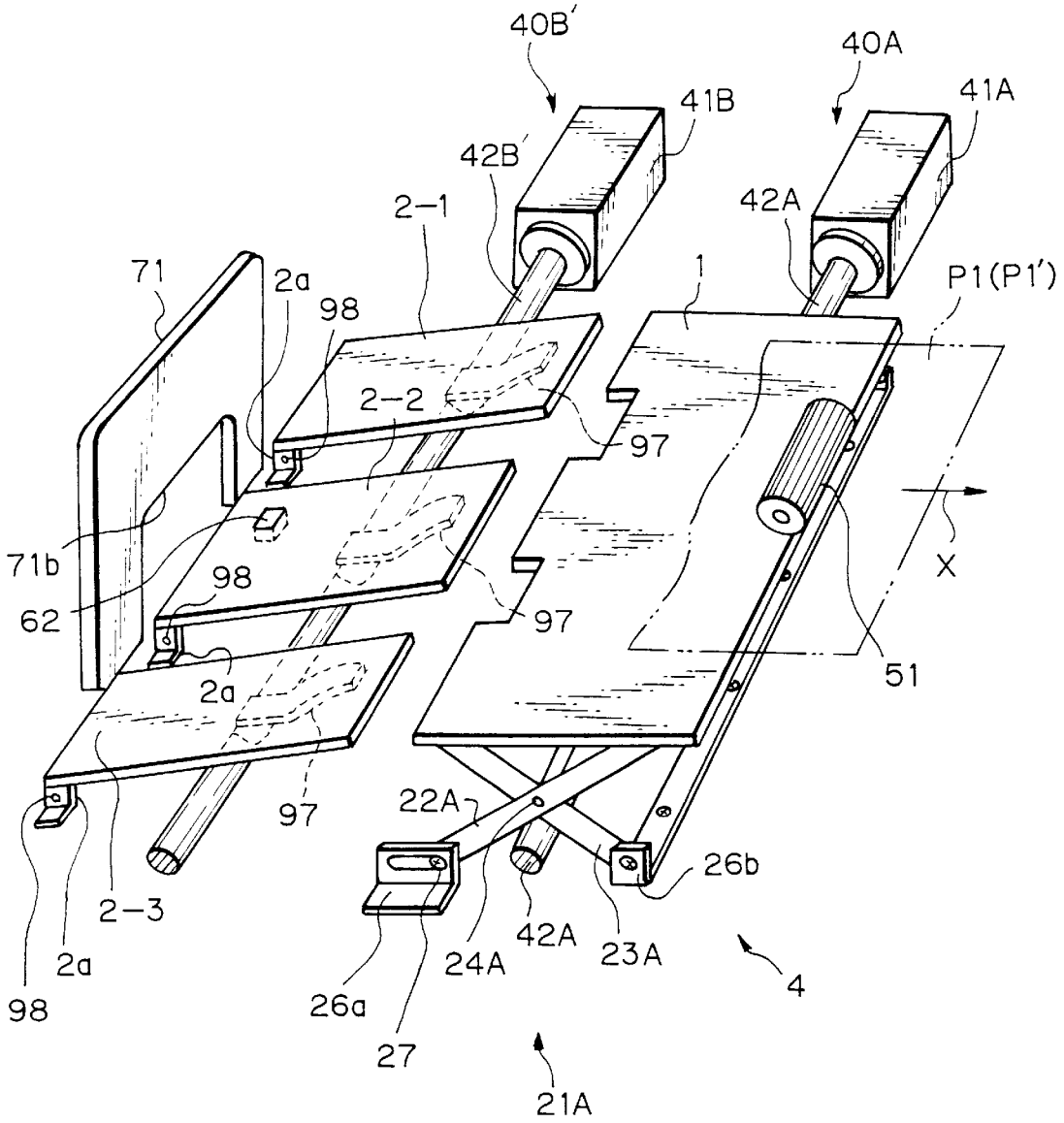
FIG. 20 is a fragmentary perspective view showing a fourth embodiment of the present invention.

Referring to FIG. 20, a fourth embodiment of the present invention will be described. In the first embodiment shown in FIGS. 2–11, when the papers P2 of relatively great size are stacked over the two trays 1 and 2 in a single stack, the interlocking means raises the tray 2 in interlocked relation to the elevation of the tray 1 while maintaining the tray 2 in substantially the horizontal position. By contrast, in the above condition, the fourth embodiment raises the front portion of the tray 2 in the direction X (right portion as viewed in FIG. 20) in interlocked relation to the elevation of the tray 1. Because the three parts 2-1, 2-2 and 2-3 of the tray 2 are angularly moved upward in a cantilevered fashion, as will be described later, they are void of the flanges extending to the right (front in the direction X) from the tray 2 of the first embodiment.

In this embodiment, the interlocking means includes three cantilevered levers 97 respectively contacting the undersides of the right portions of the tray parts 2-1, 2-2 and 2-3 for moving them up and down. The levers 97 are driven by drive means 40B'. The tray parts 2-1 through 2-3 each has a front and a rear support portion 2*a* at its left end, as illustrated. The support portions 2*a* are rotatably supported by a shaft 98 affixed to the bottom surface of the case 5A of the left tray unit 5 (not shown in FIG. 20).

The drive means 40B' includes a reversible left stepping motor or drive source 41B' affixed to the case 5A. A drive shaft 42B' is connected to the output shaft of the motor 41B' and extends in the front-and-rear direction. The levers 97 each has its one end affixed to the drive shaft 42B' below the associated tray part 2-1, 2-2 or 2-3 and has the other end contacting the underside of the right portion of the tray part. The other end of the drive shaft 42B' remote from the motor 40B' is rotatably supported by a bearing not shown. The CPU of the controller drives the motor 41B' with drive pulses via the motor driver such that when the papers P2 of relatively great size are stacked over the two trays 1 and 2, the levers 97 raise the tray 2 in interlocked relation to the elevation of the tray 1 while maintaining the right ends of the tray parts 2-1 through 2-3 substantially flush with the tray 1.

The above embodiment is effective if importance is not attached to the notable advantage available with the interlocking mechanism of the first embodiment. In the illustrative embodiment, at least when the right tray 1 is raised, the front portion (right end portion) of the stack P2 on the left tray 2 is held in a substantially constant position. This successfully prevents the deformation of the portion of the stack P2 contacting the pick-up roller 51 from deforming as far as possible and thereby insures more stable paper feed than conventional.

5th Embodiment

A fifth embodiment of the present invention will be described with reference to FIGS. 21 and 22. This embodiment is essentially similar to the first embodiment of FIGS. 2–11 except for the following. As shown, in the upper paper feed section 201, a right tray unit 104 and a left tray unit 105 are substituted for the right tray unit 4 and left tray unit 5, respectively. In the lower paper feed section 202, a bottom tray unit 106 is substituted for the bottom tray unit 12. Further, shifting means 108 is substituted for the shifting means 70.

The left tray unit 105 includes a left tray or second tray 102 in place of the left tray 2 of the first embodiment. The left tray 102 is located beside a right tray 101 in substantially the horizontal direction and loaded with the papers P1'. Interlocking means having a wire type elevation mechanism 110B and drive means 120B for driving the elevation mechanism 120B is substituted for the interlocking means including the parallel link mechanism 21B and drive means 40B. The elevation mechanism 110B supports the left tray 102 such that the tray 102 is movable up and down in substantially the horizontal position. In the illustrative embodiment, when the papers P2 of relatively large size are stacked over the two trays 101 and 102 in a single stack, the interlocking means raises the left tray 102 in interlocked relation to the elevation of the right tray 101 while maintaining it in substantially the horizontal position.

The right tray 101 included in the right tray unit 104 is loaded with the papers P1. Horizontal elevating means including a wire type elevation mechanism 110A and drive means 120A for driving the elevation mechanism 110A is substituted for the horizontal elevating means including the parallel link mechanism 21A and drive means 40A. The elevation mechanism 110A supports the right tray 101 such that the tray 101 is movable up and down in substantially the horizontal position.

In the bottom tray unit 106, horizontal elevating means including a wire type elevation mechanism 110C and drive means 120C for driving the elevation mechanism 110C is substituted for the horizontal elevation mechanism including the parallel link mechanism 21C and drive means 40C. The elevation mechanism 110C supports the bottom tray 3 such that the tray 3 is movable up and down in substantially the horizontal position.

In the illustrative embodiment, too, the upper paper feed section 201 is selectively operable in the tandem paper feed mode or the non-tandem paper feed mode. The papers P2 greater in size than at least the papers that can be stacked on the right tray 101 or the left tray 102 may be stacked over the two trays 101 and 102 in a single stack and fed by the paper feeding means 50. The trays 101 and 102 are respectively included in the right tray unit 104 and left tray unit 105 which are independent of each other and movable into and out of the paper feeder frame 200B in the direction Y and the opposite direction stated earlier.

The left tray unit 105, including the shifting means 108, will be described specifically before the right tray unit 104 and bottom tray unit 106 for facilitating an understanding of the illustrative embodiment. In FIG. 22, side walls 118B and the side fences 29*a* and 29*b* are not shown. In FIGS. 21 and 22, the side fences 13*a* and 13*b*, back fences 15 and 16 and mechanism for moving the back fences 15 and 16 are not shown.

The left tray 102 is implemented as a single molding formed with a notch 102*a* for allowing the end fence 107 to move. Affixing members 116B and 117B are respectively mounted on the front and rear portions of the underside of the left tray 102 for affixing wires which will be described later. The affixing members 116B and 117B reinforce the left tray 102 at the same time and extend along the contour of the tray 102 including the edges of the notch 102*a*. The paper sensor 62 is positioned in the vicinity of the notch 102*a*.

Figure 21:
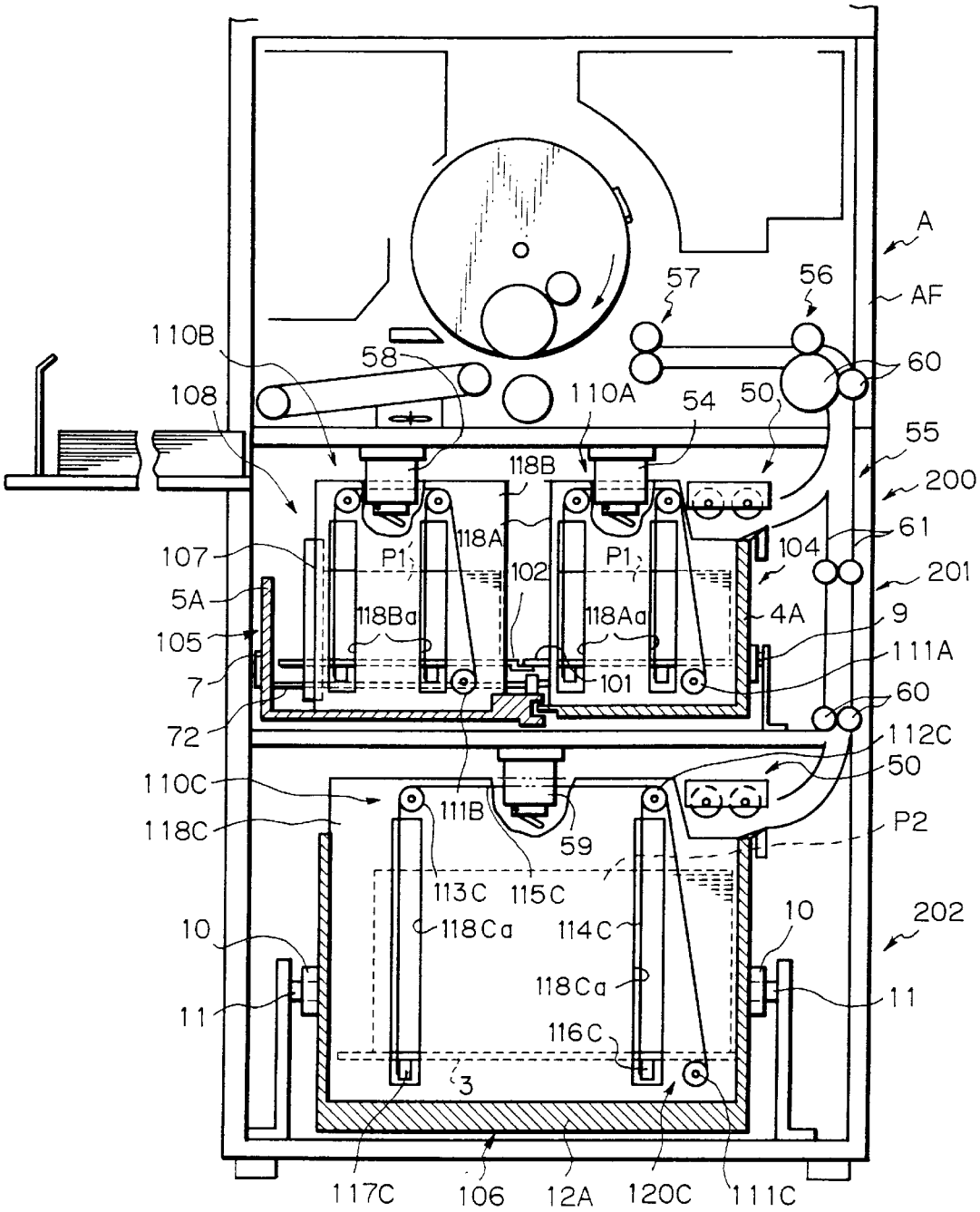
FIG. 21 is a sectional front view showing a fifth embodiment of the present invention.
Figure 22:
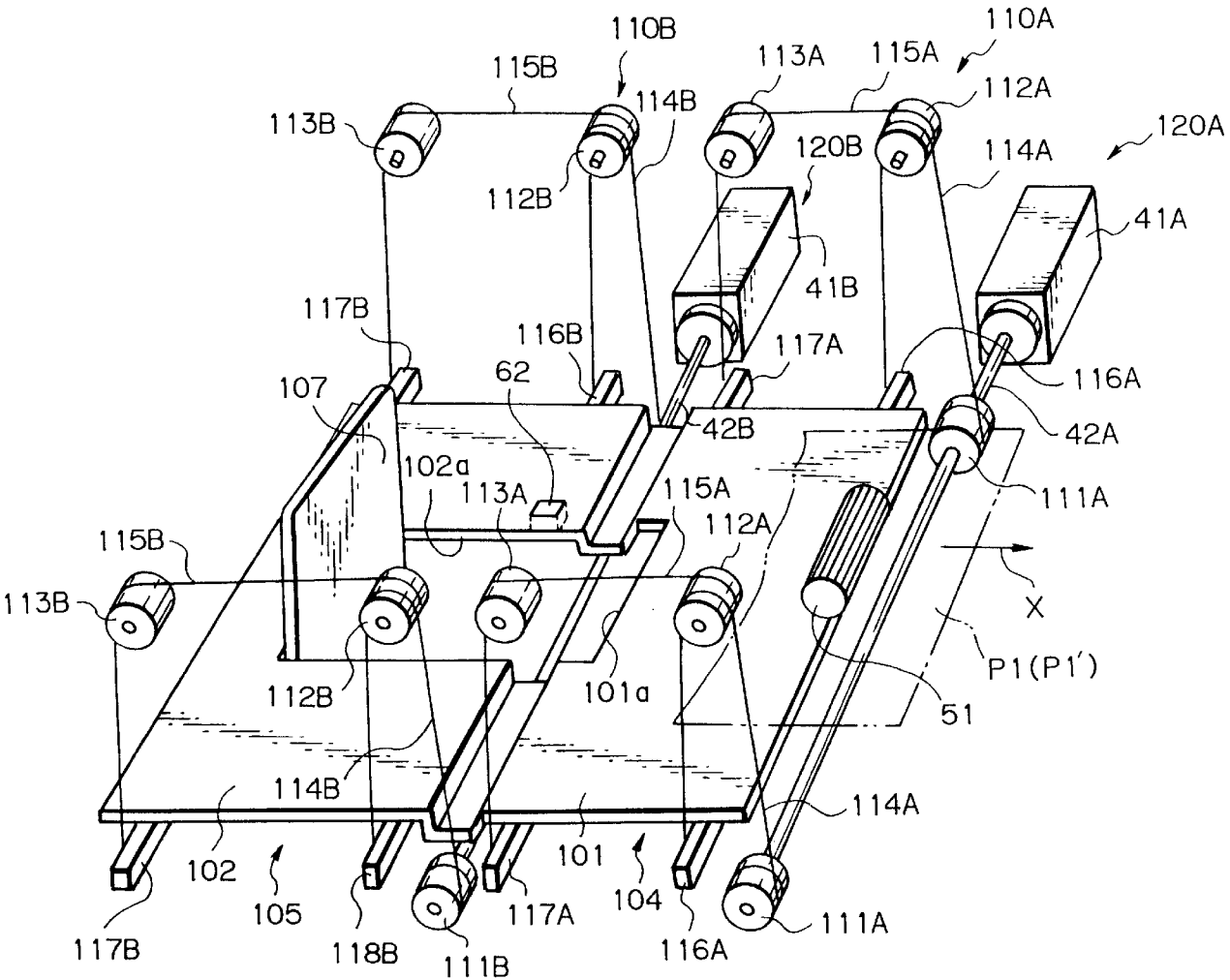
FIG. 22 is a fragmentary perspective view showing an upper paper feed section included in the fifth embodiment.

As shown in FIG. 21, side walls 118B are mounted on the front and rear portions of the inner surface of the case 5A for guiding the movement of the left tray 102 and rotatably supporting pulleys which will be described. Each side wall 118B is formed with slots 118B*a* for allowing the affixing members 116B and 117B to move up and down therein.

Because two wire type elevation mechanisms 110B are respectively arranged at the front side and rear side, as viewed in FIGS. 21 and 22, symmetrically to each other, only one of the mechanisms 110B will be described.

The elevation mechanism 110B includes a drive pulley 118B rotatably mounted on the lower portion of the outer surface of the side wall 118B. A double driven pulley 112B is rotatably mounted on the upper portion of the outer surface of the side wall 118B. A driven pulley 113B is rotatably mounted on the upper portion of the outer surface of the side wall 118B at the same height as the driven pulley 112B. The driven pulleys 113B and 112B are spaced by a preselected distance from each other. A wire 114B is passed over the drive pulley 111B and driven pulley 112B and affixed to the affixing member 116B at one end. A wire 115B is passed over the driven pulleys 112B and 113B and affixed to the affixing member 117B at one end. The wires 114B and 115B each is provided with preselected tension.

The drive means 120B is identical with the drive means 40B of the first embodiment except that the drive pulleys 111B are substituted for the lever 43 and mounted on the front and rear ends of the drive shaft 42B.

The operation of the elevation mechanism 110B and drive means 120B will be briefly described hereinafter. To raise the left tray 102, forward drive pulses (ELEVATION PULSES in FIG. 12) are applied to the left stepping motor 41B in response to a command output from the CPU. The stepping motor 41B drives the elevation mechanism 110B. Specifically, when the drive shaft 42B is rotated clockwise, as viewed in FIG. 22, by the motor 41B, the drive pulley 111B is also rotated clockwise, taking up the wire 114B. At the same time, the driven pulley 112B rotating in the same direction as the drive pulley 111B takes up the wire 115B by the same length as the wire 114B. Because both of the two elevation mechanism 110B perform such an operation at the same time, the left tray 102 is elevated in a horizontal position.

To lower the left tray 102, reverse drive pulses are applied to the stepping motor 41B in response to a command output from the CPU. In response, the motor 41B lowers the left tray 102 via the elevation mechanism 110B. Specifically, when the drive shaft 42B is rotated counterclockwise, as viewed in FIG. 22, by the motor 41B, the drive pulley 111B pays out the wire 114B. At the same time, the driven pulley 112B pays out the wire 115B by the same length as the wire 114B. Because both of the two elevation mechanism 110B perform such an operation at the same time, the left tray 102 is lowered in the horizontal position. The elevation mechanisms 110A and drive means 120A are identical in configuration and operation as the elevation mechanisms 110B and drive means 120B, respectively. The elevation mechanisms 110C and drive means 120C are also identical in configuration and operation as the elevation mechanism 110B and drive means 120B, respectively.

In the shifting means 108, the end fence 107 is void of the opening 71*b* included in the shifting means 70 of the first embodiment. The end fence 107 has a home position shown in FIGS. 21 and 22.

The right tray unit 104 will be described in detail hereinafter. The right tray 101 differs from the right tray 1 of the first embodiment, as follows. The tray 101 is formed with a single notch 101*a* for receiving the end fence 107. Affixing members 116A and 117A for affixing wires to be described are respectively mounted on the front and rear portions of the underside of the tray 101. The affixing members 116A and 117A reinforce the right tray 101 at the same time and extend along the contour of the tray 101 including the edges of the notch 101*a*.

As shown in FIG. 21, side walls 118A are mounted on the front and rear portions of the inner surface of the case 4A for guiding the movement of the right tray 101 and rotatably supporting pulleys which will be described. Each side wall 118A is formed with slots 118A*a* for allowing the affixing members 116A and 117A to move up and down therein.

The elevation mechanisms 110A are substantially identical in configuration with the elevation mechanisms 110B except for dimensions for implementing strength great enough to support papers. Therefore, the mechanisms 110A are simply distinguished from the mechanisms 110B by the addition of a suffix A. Also, the drive means 120A is substantially identical with the drive means 120B except for timing and therefore simply distinguished from the drive means 120B by the addition of the suffix A.

The bottom tray unit 106 will be described in detail hereinafter. Affixing members 116C and 117C for affixing wires to be described are respectively mounted on the front and rear portions of the underside of the bottom tray 3. The affixing members 116C and 117C reinforce the tray 3 at the same time and extend along the contour of the tray 3.

As shown in FIG. 21, side walls 118C are mounted on the front and rear portions of the inner surface of the case 12A for guiding the movement of the bottom tray 3 and rotatably supporting pulleys which will be described. Each side wall 118C is formed with slots 118C*a* for allowing the affixing members 116C and 117C to move up and down therein.

The elevation mechanisms 110C are substantially identical in configuration with the elevation mechanisms 110B except for dimensions for implementing strength great enough to support papers. Therefore, the mechanisms 110C are simply distinguished from the mechanisms 110B by the addition of a suffix A. The drive means 120C is identical with the drive means 40C of the first embodiment except that drive pulleys 111C are affixed to the the front and rear ends of a drive shaft 42C' in place of the lever 43 shown in FIG. 11.

In the illustrative embodiment, the right tray 101 and left tray 102 each is capable of moving up and down with a greater number of papers stacked thereon than in the first embodiment. Specifically, the trays 101 and 102 each allows more than 1,000 papers (plain papers) to be stacked, i.e., they allow more than 2,000 papers to be stacked in total. Of course, papers of any other size can be stacked on the trays 101 and 102, as needed. Also, the bottom tray 3 allows a greater number of papers to be stacked thereon than in the first embodiment, e.g., more than 1,000 plain papers of size A3. Papers of any other size can also be stacked on the bottom tray 3.

The paper feed operation of the illustrative embodiment will be readily understood from the flowcharts of FIGS. 12 and 13 and the above description.

So long as the problem with the wire type elevation mechanism is neglected, the above embodiment achieves an advantage that a greater number of papers P can be stacked (at least 1,000 papers of size A3), in addition to the advantages of the first embodiment.

It will be seen that the present invention provides a paper feeder and a paper tray elevation device therefor having various unprecedented advantages, as enumerated below.

(1) Even when papers of relatively great size are stacked on a first and a second tray in a single stack, they can be stably fed in a preselected position without any deformation.

(2) When substantially the center portion of the second tray is driven up and down, at least the portion of the papers contacting paper feeding means is prevented from deforming. This is also successful to insure stable paper feed.

(3) A horizontal elevation mechanism for each tray is simple in structure and low cost and allows a driving force to be increased.

(4) A torque for a link is achieved most efficiently when the maximum number of papers are stacked. The paper feeder therefore features a high driving efficiency in the design aspect.

(5) Each tray is movable up and down with a greater number of papers stacked thereon.

(6) Even when a great number of papers of relatively great size are stacked over the first and second trays, the front portion the papers on the second tray 2 in the paper feed direction is held in a substantially constant position at least when the first tray is raised. This successfully prevents the portion of the papers contacting the paper feeding means from deforming as far as possible and thereby insures more stable paper feed than conventional.

(7) Papers can be replenished without interruption and therefore with a high efficiency, enhancing the productivity of the paper feeder.

Various modifications will become possible for those skilled in the art after receiving the teachings of the present disclosure without departing from the scope thereof.

What is claimed is:

1. A paper feeder comprising:

a first tray movable up and down with a plurality of papers stacked thereon;

paper feeding means for feeding the papers from said first tray in a preselected paper feed direction;

a second tray positioned beside said first tray in a substantially horizontal direction and movable up and down with a plurality of papers stacked thereon;

shifting means for shifting an entire stack of the papers from said second tray to said first tray;

horizontal elevating means for elevating said first tray while maintaining said first tray in a substantially horizontal position; and interlocking means for interlocking, when papers of a size relatively greater than a size of the papers to be stacked on said first tray or said second tray are stacked over said first tray and said second tray in a single stack, said second tray in an interlocked relation to an elevation of said first tray while maintaining said second tray in a substantially horizontal position and when said first tray is elevated, said second tray is in the interlocked relation to the first tray, wherein the papers of the relatively greater size stacked over said first tray and said second tray are fed by said paper feeding means.

2. A paper feeder as claimed in claim 1, wherein said second tray comprises a center portion movable up and down, and said interlocking means causing said center portion to move up and down.

3. A paper feeder as claimed in claim 1, wherein said interlocking means comprises a parallel link mechanism movable up and down while maintaining said second tray in the substantially horizontal position, and drive means for driving said parallel link mechanism.

4. A paper feeder as claimed in claim 3, wherein said parallel link mechanism comprises an X-shaped link.

5. A paper feeder as claimed in claim 4, wherein said drive means is engaged with a shaft connecting said X-shaped link for causing said second tray to move up and down.

6. A paper feeder as claimed in claim 4, wherein said drive means is engaged with a lower end portion of said X-shaped link for causing said second tray to move up and down.

7. A paper feeder as claimed in claim 1, wherein said interlocking means comprises a wire type elevation mechanism moving said second tray up and down while maintaining said second tray in the substantially horizontal position, and drive means for driving said wire type elevation mechanism.

8. A paper feeder as claimed in claim 1, wherein said second tray is removable from a body of said paper feeding means in a direction perpendicular to the paper feed direction, said paper feeding means further comprising supporting means removably supporting said second tray.

9. A paper feeder comprising:

a first tray movable up and down with a plurality of papers stacked thereon;

paper feeding means for feeding the papers from said first tray in a preselected paper feed direction;

a second tray positioned beside said first tray in a substantially horizontal direction and movable up and down with a plurality of papers stacked thereon;

shifting means for shifting an entire stack of the papers from said second tray to said first tray;

horizontal elevating means for elevating said first tray while maintaining said first tray in a substantially horizontal position; and interlocking means for interlocking, when papers of a size relatively greater than a size of the papers to be stacked on said first tray or said second tray are stacked over said first tray and said second tray in a single stack, said second tray in an interlocked relation to an elevation of said first tray and when said first tray is elevated, said second tray is in the interlocked relation to the first tray, wherein the papers of relatively greater size stacked over said first tray and said second tray are fed by said paper feeding means.

10. A paper feeder as claimed in claim 9, wherein said second tray is removable from a body of said paper feeding means in a direction perpendicular to the paper feed direction, said paper feeding means further comprising supporting means for removably supporting said second tray.

11. A paper feeder comprising:

a first tray configured to move up and down with a plurality of papers stacked thereon;

a paper feeding unit configured to feed the papers from said first tray in a preselected paper feed direction;

a second tray positioned beside said first tray in a substantially horizontal direction and movable up and down with a plurality of papers stacked thereon;

a shifting mechanism configured to shift an entire stack of the papers from said second tray to said first tray;

a horizontal elevating mechanism configured to elevate said first tray while maintaining said first tray in a substantially horizontal position; and an interlocking mechanism configured to interlock said second tray in an interlocked relation to an elevation of said first tray while maintaining said second tray in a substantially horizontal position when papers of a size relatively greater than a size of the papers to be stacked on said first tray or said second tray are stacked over said first tray and said second tray in a single stack and when said first tray is elevated, said second tray is in the interlocked relation to the first tray, wherein the papers of relatively greater size stacked over said first tray and said second tray are fed by said paper feeding unit.

12. A paper feeder as claimed in claim 11, wherein said second tray comprises a center portion movable up and down, and said interlocking mechanism causes the center portion to move up and down.

13. A paper feeder as claimed in claim 11, wherein said interlocking mechanism comprises:

a parallel link mechanism movable up and down while maintaining said second tray in the substantially horizontal position; and a drive unit configured to drive said parallel link mechanism.

14. A paper feeder as claimed in claim 13, wherein said parallel link mechanism comprises an X-shaped link.

15. A paper feeder as claimed in claim 14, wherein said drive unit is engaged with a shaft connecting said X-shaped link for causing said second tray to move up and down.

16. A paper feeder as claimed in claim 14, wherein said drive unit is engaged with a lower end portion of said X-shaped link for causing said second tray to move up and down.

17. A paper feeder as claimed in claim 11, wherein said interlocking mechanism comprises:

a wire type elevation mechanism configured to move the second tray up and down while maintaining the second tray in the substantially horizontal position; and a drive unit configured to drive the wire type elevation mechanism.

18. A paper feeder as claimed in claim 11, wherein the second tray is removable from a body of said paper feeding unit in a direction perpendicular to the paper feed direction, and the paper feeding unit further includes a supporting mechanism configured to removably support said second tray.

19. A paper feeder comprising:

a first tray configured to move up and down with a plurality of papers stacked thereon;

a paper feeding unit configured to feed the papers from said first tray in a preselected paper feed direction;

a second tray positioned beside said first tray in a substantially horizontal direction and configured to move up and down with a plurality of papers stacked thereon;

a shifting mechanism configured to shift the plurality of papers from said second tray to said first tray;

a horizontal elevating mechanism configured to elevate said first tray while maintaining said first tray in a substantially horizontal position; and an interlocking mechanism configured to interlock said second tray in an interlocked relation to an elevation of said first tray when papers of a size relatively greater than a size of the papers to be stacked on said first tray or said second tray are stacked over said first tray and said second tray in a single stack and when said first tray is elevated, said second tray is in the interlocked relation to the first tray, wherein the papers of relatively greater size stacked over said first tray and said second tray are fed by the paper feeding unit.

20. A paper feeder as claimed in claim 19, wherein said second tray is removable from a body of said paper feeding unit in a direction perpendicular to the paper feed direction, and said paper feeding unit further includes a supporting mechanism configured to removably support said second tray.

* * * * *

UNITED STATES PATENT AND TRADEMARK OFFICE

CERTIFICATE OF CORRECTION

PATENT NO. : 6,123,329

DATED : September 26, 2000

INVENTOR(S): MITSUAO SATO, et al.

It is certified that an error appears in the above-identified patent and that said Letters Patent is hereby corrected as shown below:

Column 1, line 6, change "to" to --for--.
Column 2, line 3, change "tacked" to --stacked--.
Column 5, line 23, after "of" and before "selectively" insert --being--;
line 53, after "it" and before "a"insert --in--.
Column 7, line 35, change "angel" to --angle--;
line 44, delete ", but".
Column 8, line 2, change "23" to --2-3--.
Column 10, line 9, change "an" to --and--.
Column 11, line 6, change "Aspecific" to --A specific--.
Column 14, line 6, change "mans" to --means--;
line 8, change "pulley" to --roller--;
line 48, change "mans" to --means--;
line 53, in the first and second occurrences change "2-2" to --2-2'--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*